US007386895B2

(12) United States Patent
Hayashi et al.

(10) Patent No.: US 7,386,895 B2
(45) Date of Patent: Jun. 17, 2008

(54) OPENING/CLOSING DEVICE FOR TOILET SEAT OR TOILET LID, AND TRANSMISSION UNIT FOR THE DEVICE

(75) Inventors: Ryosuke Hayashi, Fukuoka (JP); Yoshiro Terada, Fukuoka (JP); Satoshi Kato, Fukuoka (JP); Kenji Hashidume, Fukuoka (JP)

(73) Assignee: Toto, Ltd., Fukuoka (JP)

( * ) Notice: Subject to any disclaimer, the term of this patent is extended or adjusted under 35 U.S.C. 154(b) by 331 days.

(21) Appl. No.: 10/516,245

(22) PCT Filed: May 29, 2003

(86) PCT No.: PCT/JP03/06760

§ 371 (c)(1),
(2), (4) Date: Nov. 30, 2004

(87) PCT Pub. No.: WO03/101269

PCT Pub. Date: Dec. 11, 2003

(65) Prior Publication Data

US 2005/0172384 A1 Aug. 11, 2005

(30) Foreign Application Priority Data

May 31, 2002 (JP) ..... 2002-160666
Nov. 6, 2002 (JP) ..... 2002-322991

(51) Int. Cl.
*A47K 13/12* (2006.01)

(52) U.S. Cl. ..... 4/246.1; 4/248

(58) Field of Classification Search ..... 4/241, 4/248

See application file for complete search history.

(56) References Cited

U.S. PATENT DOCUMENTS 5,901,383 A 5/1999 Yanagawa et al. ..... 4/236
5,996,132 A * 12/1999 Sorimachi ..... 4/236
7,150,049 B1 * 12/2006 Fitch ..... 4/248 X

FOREIGN PATENT DOCUMENTS

JP 62-95698 6/1987
JP 10-201670 8/1998
WO 95/17844 7/1995

* cited by examiner

*Primary Examiner*—Robert M. Fetsuga
(74) *Attorney, Agent, or Firm*—Wenderoth, Lind & Ponack, L.L.P.

(57) ABSTRACT

A lifting and lowering device (31) for a toilet seat or a toilet cover has a swing shaft (17) provided on a swing center line (C) of a toilet seat (3) or a toilet cover (4) that swings around base end portions (3*l*, 4*l*), respectively, and rises. The device includes a lifting and lowering control unit (5) indirectly fixed to a toilet bowl main body (30); an output shaft (12) that is provided on the swing center line (C), one end portion of which shaft being removably connected to the swing shaft (17) of the lifting and lowering control unit (5) and the other end portion being detacheably connected to the base end portion (3*l*) of the toilet seat (3); and a toilet seat transmission unit (9) containing a tortion spring (13) that urges the output shaft (12) in a lifting direction of the toilet seat (3). The lifting and lowering device (31) for the toilet seat of toilet cover is relatively small in size and able to stabely hold the toilet seat or toilet cover in a raised position. Commonality of structural parts can be achieved depending on the magunitude of torque caused by the self weight of the toilet seat or toilet cover.

7 Claims, 21 Drawing Sheets

OPENING/CLOSING DEVICE FOR TOILET SEAT OR TOILET LID, AND TRANSMISSION UNIT FOR THE DEVICE

TECHNICAL FIELD

The present invention relates to a lifting and lowering device for a toilet seat or toilet cover provided in a Western-style toilet, and a transmission unit for composing the lifting and lowering device.

BACKGROUND ART

A conventional Western-style toilet has a simple structure, in which a toilet seat and a toilet cover are pivotally supported so as to rise and fall on the top face of a rim on the back side of a toilet bowl main body. In recent years, however, a toilet seat device with a function of cleansing the bottom with warm water or a heated toilet seat device has been installed in the toilet. In such a toilet, the toilet seat and the toilet cover are pivotally supported by a container case, which is disposed in the top surface of the rim. As the container case contains electrical components and the like for operating and controlling the cleansing function with warm water and the function of heating the toilet seat, the container necessarily protrudes from the top face of the rim. As a result, the pivotally supported positions of the toilet seat and the toilet cover are higher than those of the conventional Western-style toilet.

When the pivotally supported positions of the toilet seat and the toilet cover are high, as described above, it becomes difficult to keep the toilet seat and the toilet cover in raised positions in a case where a man urinates. Thus, there is a possibility that the toilet seat and the toilet cover fall down during urination.

To prevent such inconvenience, in the toilet having the warm-water cleansing toilet seat device, a lifting and lowering control unit is fixed in the container case of the debit toilet seat device. In the lifting and lowering control unit, a torsion spring for urging the toilet seat and the toilet cover in a lifting direction is integrated into an automatic lifting and lowering device or a damper device. The automatic lifting and lowering device automatically lifts and lowers the toilet seat and the toilet cover by a user detection signal, a remote control operation, or the like. The damper device is provided to gently lower the toilet seat and the toilet cover. Such structure makes it possible to lightly lift the toilet seat and the toilet cover, and securely keeps the toilet seat and the toilet cover in a lifted state (a state in which the toilet seat and the toilet cover are raised) while preventing the toilet seat and the toilet cover from being undesirably lowered.

By the way, the scene of product development aims to efficiently produce a product group with wide variations in order to meet various market needs. Therefore, products with several variations are often developed based on, for example, one type of basic specifications in accordance with various requirements of a customer.

Accordingly, also in the automatic lifting and lowering devices and the damper devices for the warm-water cleansing toilet seat device, it is necessary to develop various devices corresponding to different self weight torque properties of a plurality of types of toilet seats and toilet covers in different product variations. Thus, in the automatic lifting and lowering device, products with many variations are developed by, for example, increasing torque of a drive motor, varying a speed reducing ratio of a gear in a drive system, or varying the specifications of the torsion spring. The damper devices are also developed in accordance with the different product variations by, for example, increasing and decreasing the capacity of a damper chamber, or varying the specifications of the torsion spring.

Thus, the types of parts increase in accordance with an increase in the product variations, so that not only huge manufacturing cost and management cost are required, but also a long period of time is needed for the manufacturing of the parts. An increase in the variations also increases assembly cost and management cost during manufacture.

In the conventional warm-water cleansing toilet seat device, the torsion spring for urging the toilet seat and the toilet cover to the lifting direction is provided in the automatic lifting and lowering device or the damper device. Thus, these devices necessarily become large due to space for attaching the torsion spring. This is one of the hindrances to the weight reduction and size reduction of the warm-water cleansing toilet seat device.

The present invention aims to solve the foregoing problems. An object of the present invention is to provide a relatively small lifting and lowering device for a toilet seat or toilet cover which can stably hold the toilet seat or toilet cover in a raised position, and achieve commonality of structural parts in accordance with the magnitude of self weight torque of the toilet seat or toilet cover, and to provide a transmission unit for composing the lifting and lowering device.

SUMMARY OF THE INVENTION

A lifting and lowering device for a toilet seat or toilet cover according to the present invention comprises a lifting and lowering control unit, and a transmission unit. The lifting and lowering control unit has an axial member disposed on a swing center line of the toilet seat or toilet cover, which is lifted and lowered pivotally about base end portions. The lifting and lowering control unit is indirectly fixed to a toilet bowl main body or the base end portion of the toilet seat. The transmission unit has a swing shaft and urging means. The swing shaft disposed on the swing center line is coupled to the axial member of the lifting and lowering control unit. The urging means urges the toilet seat or toilet cover in a lifting direction. According to this structure, the lifting and lowering control unit for carrying out the lifting and lowering operation of the toilet seat or toilet cover is separated from the transmission unit for urging the toilet seat or toilet cover in the lifting direction, so that it is possible to miniaturize the lifting and lowering device. The toilet seat or toilet cover can be stably held in a raised position. It is also possible to achieve the commonality of the structural parts in accordance with the magnitude of the self weight torque of the toilet seat or toilet cover.

The lifting and lowering control unit may be indirectly fixed on the toilet bowl main body. The transmission unit may be disposed in the base end portion of the toilet seat or toilet cover, and one end portion of the swing shaft may be detachably coupled to the axial member of the lifting and lowering control unit. According to this structure, it becomes possible to detach the transmission unit from the lifting and lowering control unit together with the toilet seat or toilet cover, so that workability in cleaning or the like is improved. It is also possible to exchange the transmission unit while leaving the lifting and lowering control unit on a toilet, so that it is possible to achieve the commonality of the structural parts in accordance with the magnitude of the self weight torque of the toilet seat or toilet cover.

If the lifting and lowering control unit has a power source for rotating the axial member, it is possible to automatize the lifting and lowering operation of the toilet seat or toilet cover, thereby making it possible to eliminate a load of a user. If the lifting and lowering control unit is a damper unit having the function of controlling the swing of the swing shaft of the transmission unit in the direction of lowering the toilet seat or toilet cover, the toilet seat or toilet cover is slowly lowered after use without using manual power. Therefore, it is possible to prevent the occurrence of noise and damage to the structural parts.

To detachably couple the lifting and lowering control unit to the transmission unit, it is preferable to provide a fitting means. The fitting means can improve the attachment and detachment workability of the transmission unit with respect to the lifting and lowering control unit, and can stabilize a coupled state.

As the fitting means, it is preferable that one of the lifting and lowering control unit and the transmission unit be provided with a protruding section, and the other be provided with a nipper section for nipping the protruding section. According to this structure, it is possible to carry out attaching/detaching operations between the lifting and lowering control unit and the transmission unit by a simple operation, that is, by fitting/detaching the protruding section into/from the nipper section, without using any tools.

Also, it is preferable that a guide face, which guides the protruding section into the fitting position of the nipper section, be provided in a part of the protruding section. In particular, the guide face makes it possible to smoothly guide the protruding section into the predetermined position of the nipper section by a slide on the guide face. Therefore, coupling workability is significantly improved, and it is possible to obtain a secure coupled state.

As coupling means between the axial member of the lifting and lowering control unit and the swing shaft of the transmission unit, on the other hand, it is preferable that one of axial end faces of the axial member and the swing shaft be provided with a protruding section, and a cutout section be formed on an axial end face of the other. The protruding section can be fitted into the cutout section. The coupling means makes it possible to attach/detach the axial member to/from the swing shaft by a simple operation, that is, by fitting the protruding section formed on the axial end face of one of the axial member and the swing shaft into the cutout section of the other of the axial member and the swing shaft, without using any tools.

In this case, a guide face that guides the protruding section into the fitting position of the cutout section may be provided in a part of the cutout section, as with above. The guide face makes it possible to smoothly guide the protruding section formed on the axial end face of one of the axial member and the swing shaft into the predetermined position of the cutout section formed on the axial end face of the other of the axial member and the swing shaft, by a slide on the guide face. Therefore, coupling workability is improved, and it is possible to obtain a secure coupled state.

Furthermore, an urging force generation mechanism that generates urging force on the swing shaft of the transmission unit by the coupling between the axial member of the lifting and lowering control unit and the swing shaft of the transmission unit may be provided. According to this structure, the urging force can be immediately generated on the swing shaft of the transmission unit by coupling the axial member of the lifting and lowering control unit to the swing shaft of the transmission unit. Accordingly, it is possible to improve the function of preventing the toilet seat or toilet cover from falling down.

Next, a transmission unit according to the present invention comprises a swing shaft, a container cylinder, and urging means. The swing shaft has coupling means coupled to an axial member of a lifting and lowering control unit, which is indirectly fixed to a toilet bowl main body or a base end portion of the toilet seat. The container cylinder rotatably contains the swing shaft. The urging means disposed in the container cylinder urges the swing shaft in a constant direction. According to this structure, a lifting and lowering device is composed of a combination of a lifting and lowering control unit that carries out the lifting and lowering operation of the toilet seat or toilet cover, and the toilet seat or toilet cover, so that it is possible to miniaturize the lifting and lowering device. When the lifting and lowering device for the toilet seat or toilet cover is structured, the toilet seat or toilet cover can be stably held in the raised position. Also, it is possible to achieve the commonality of the structural parts in accordance with the magnitude of the self weight torque of the toilet seat or toilet cover.

To keep the swing shaft in an urged state, it is preferable to provide a stopper for determining the swing start position of the swing shaft. According to this structure, when a lifting and lowering device is composed of a combination of the transmission unit, the lifting and lowering control unit, and the toilet seat or toilet cover, the urging force can be immediately generated on the swing shaft of the transmission unit, upon coupling the axial member of the lifting and lowering control unit to the swing shaft of the transmission unit. Therefore, it is possible to improve the function of preventing the toilet seat or toilet cover from falling down.

If a plurality of torsion springs are disposed in the container cylinder of the transmission unit, the urging force is changeable by selecting the torsion springs. Thus, it becomes possible to properly meet the variety of the self weight torque of the toilet seat or toilet cover. Stress applied to the torsion springs and support members for supporting the torsion springs is dispersed, so that it is also possible to increase the durability of the torsion spring and the support members.

The transmission unit may have an intermediate swing shaft and two springs. The intermediate swing shaft is contained in the container cylinder coaxially with the swing shaft. One end of one of the torsion springs is fixed to the container cylinder, and the other end thereof is fixed to the intermediate swing shaft. One end of the other torsion spring is fixed to the intermediate swing shaft, and the other end thereof is fixed to the swing shaft. According to this structure, even if enough space for disposing the springs cannot be secured, it is possible to increase the number of windings of the torsion spring inside the container cylinder. Accordingly, a spring with a relatively small spring constant is usable, and it is possible to reduce variation in torsion spring torque. Therefore, the lifting and lowering operation of the toilet seat or toilet cover becomes smooth, and it is possible to prevent the toilet seat from being incompletely lowered.

Furthermore, if water-proof means is provided to prevent water from getting into the container cylinder, it is possible to protect a metal part, such as the torsion spring contained in the container cylinder, from rust and corrosion. Therefore, reliability and durability are improved.

BRIEF DESCRIPTION OF THE DRAWINGS

FIG. 18(*b*) is a view shown in a direction of an arrow R in FIG. 18(*a*).

DETAILED DESCRIPTION OF THE INVENTION

A first embodiment of the present invention will be described on the basis of FIGS. 1 to 22.

Figure 1:
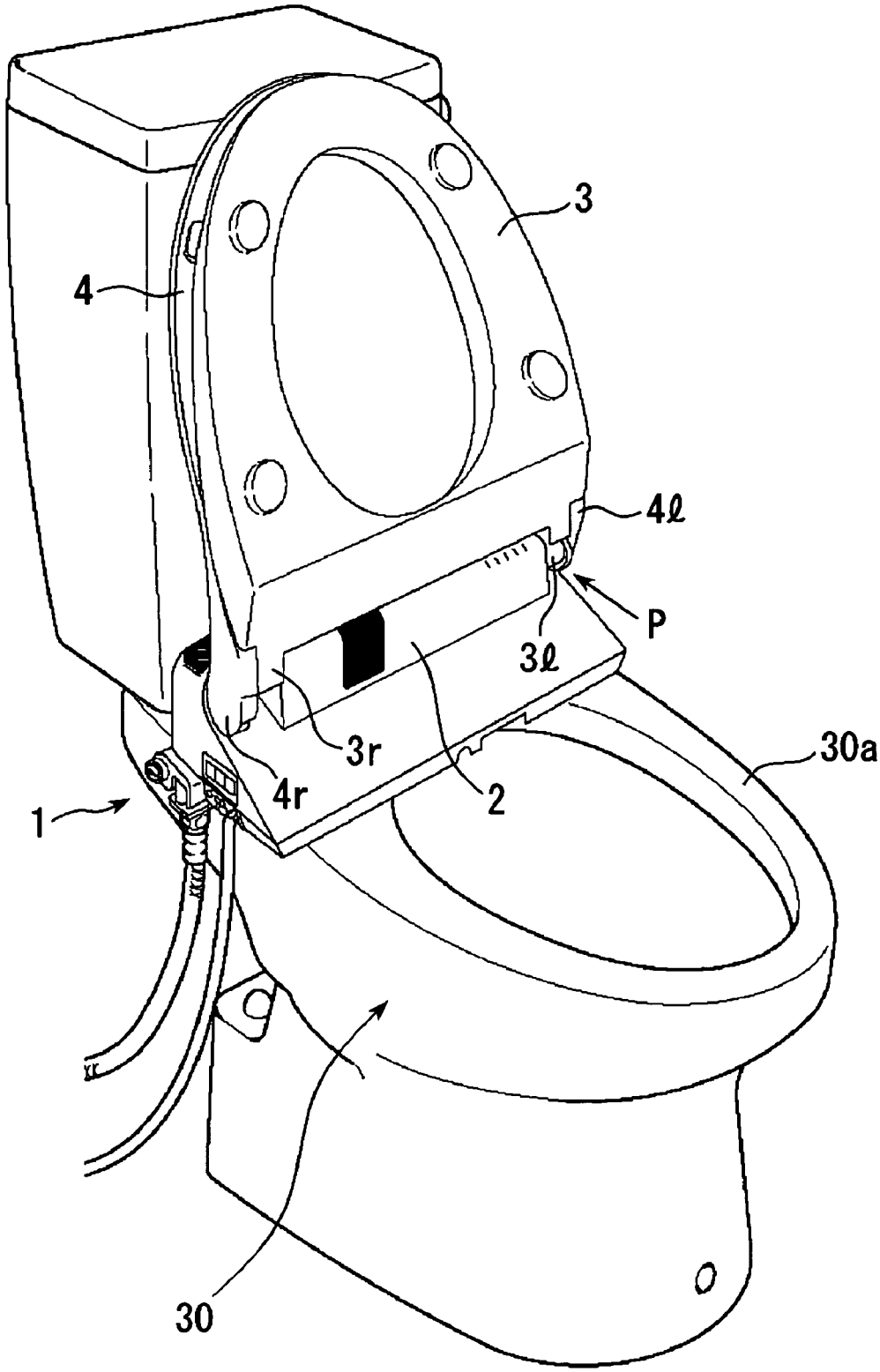
FIG. 1 is a perspective view of a warm-water cleansing toilet seat device, in which a lifting and lowering device for a toilet seat or toilet cover according to a first embodiment of the present invention is installed.

Referring to FIG. 1, a warm-water cleansing toilet seat device 1 is attached to a toilet bowl main body 30, in such a manner that a container case 2 for composing the device 1 is fixed on the top face of a rim 30*a* on the back side of the toilet bowl main body 30. A toilet seat 3 and a toilet cover 4 are attached to the container case 2 rotatably with respect to base end portions 3*l*, 3*r*, 4*l*, and 4*r*, respectively. The base end portions 3*l*, 3*r*, 4*l*, and 4*r* of the toilet seat 3 and the toilet cover 4 can be separated from the container case 2 by a mechanism, which will be described later.

Figure 2:
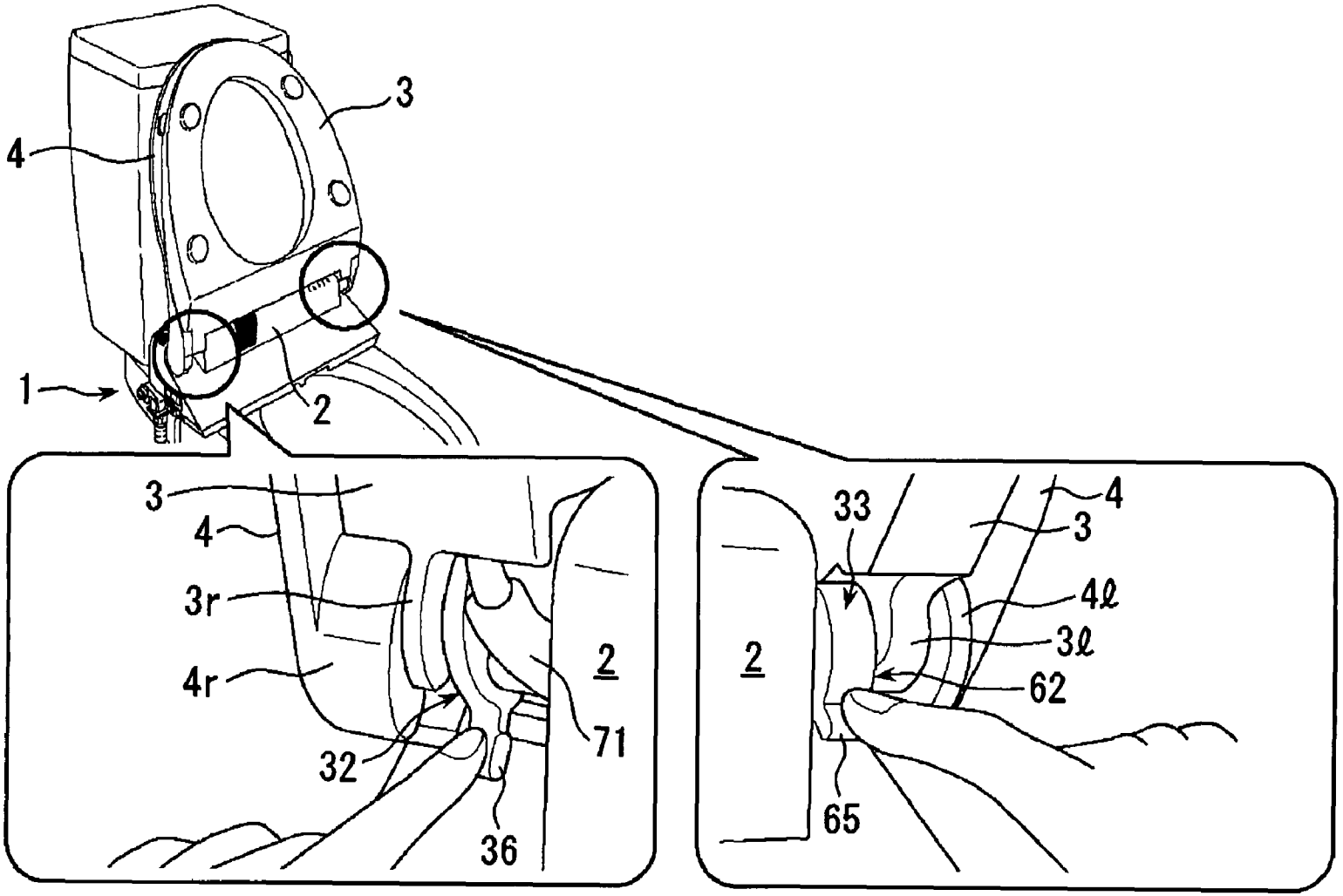
FIGS. 2 to 4 are explanatory views for explaining a method for detaching the toilet seat and the toilet cover from the warm-water cleansing toilet seat device shown in FIG. 1.

When the toilet cover 4 and the toilet seat 3 are in a lifted state (raised state), as shown in FIG. 2, a lever section 36 of a first engagement member 32 and a cord 71 are visible between the base end portion 3*r* on the left side of the toilet seat 3 and the container case 2. A lever section 65 of a lock section 62 is visible between the base end portion 3*l* on the right side of the toilet seat 3 and the container case 2.

Figure 3:
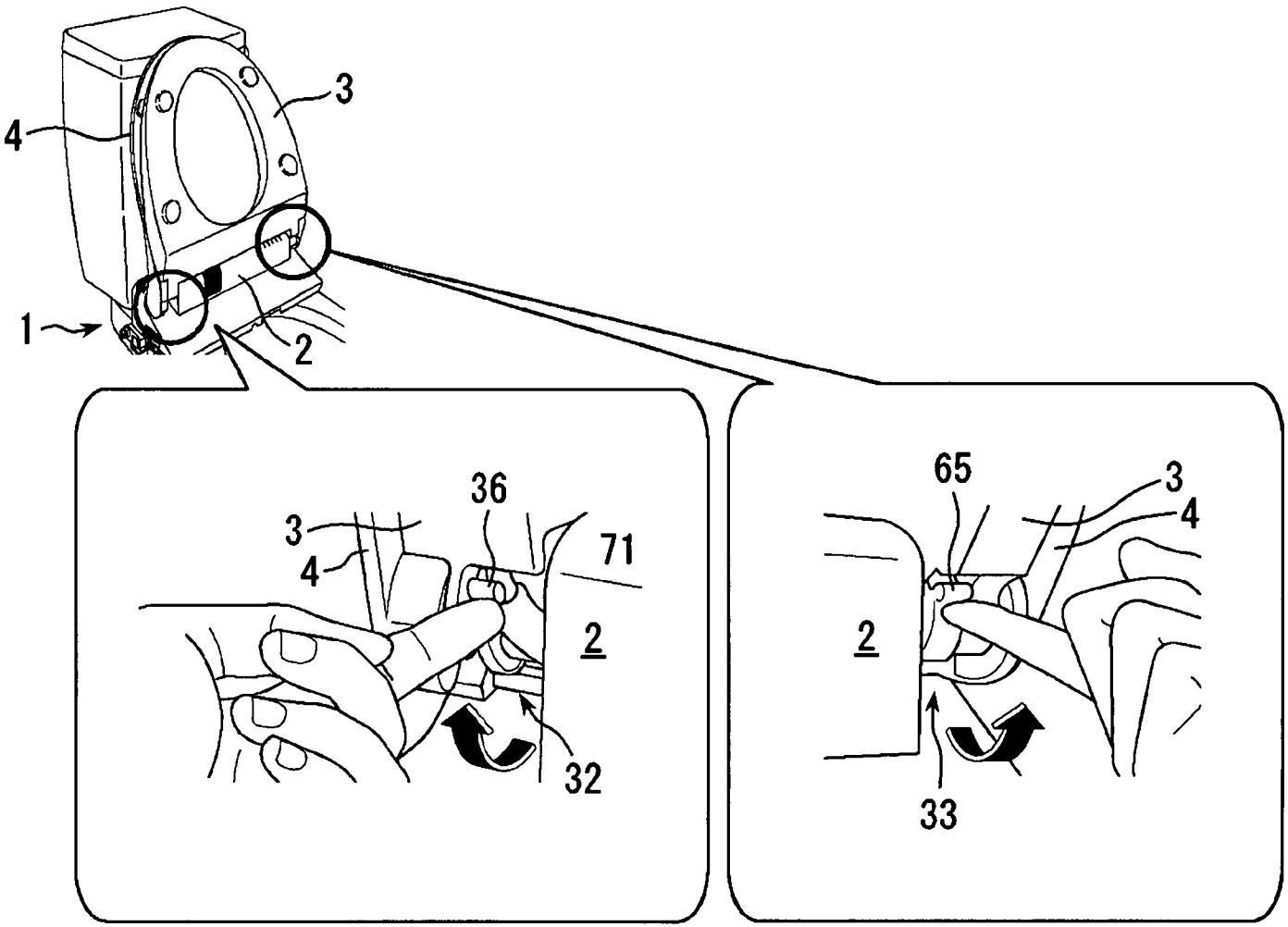

Referring to FIG. 3, the right and left lever sections 36 and 65 are moved upward as shown by arrows, to make an opening of the first engagement member 32 and an opening of a second engagement member 33 into an open state, respectively.

Figure 4:
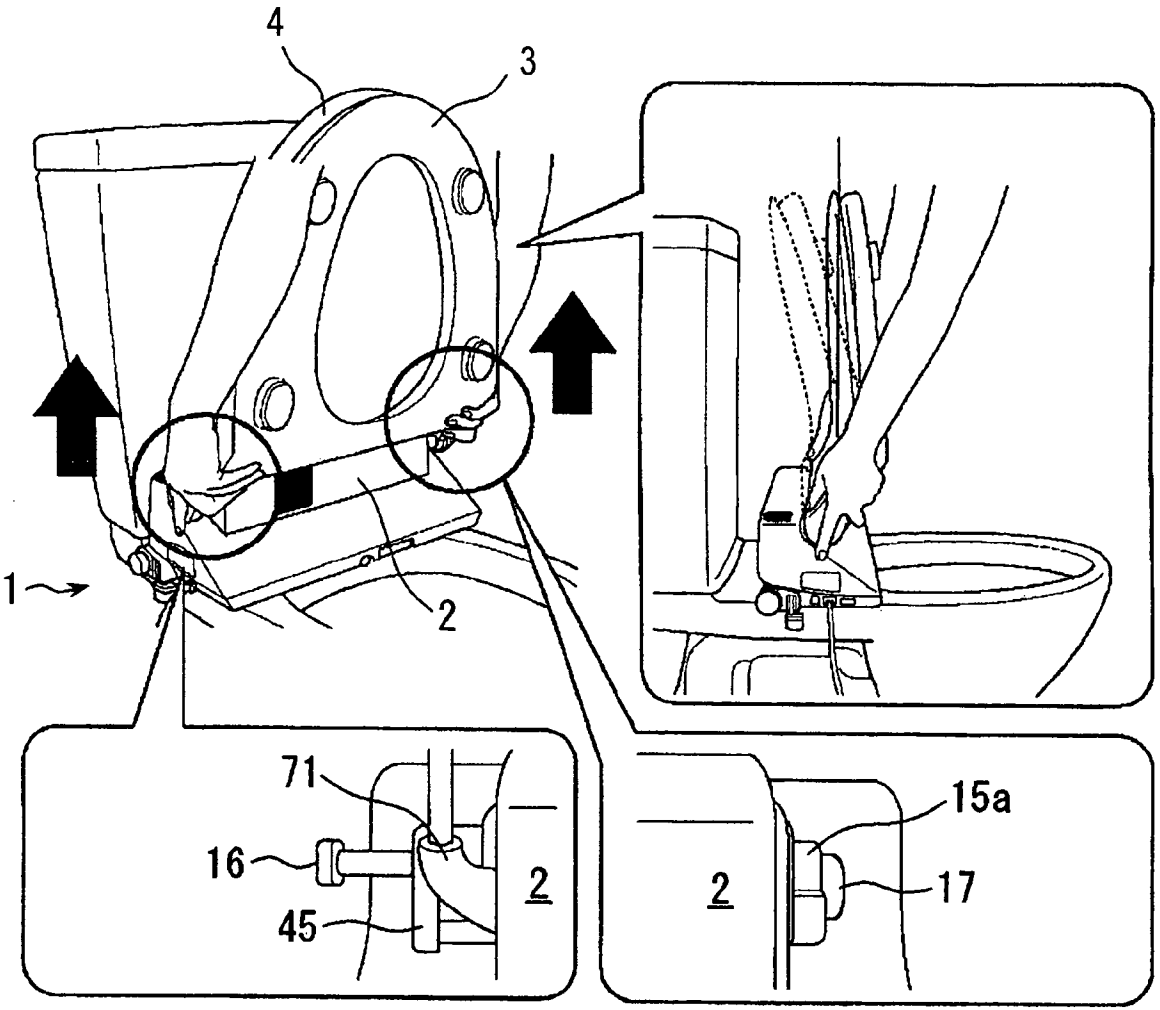
Figure 5:
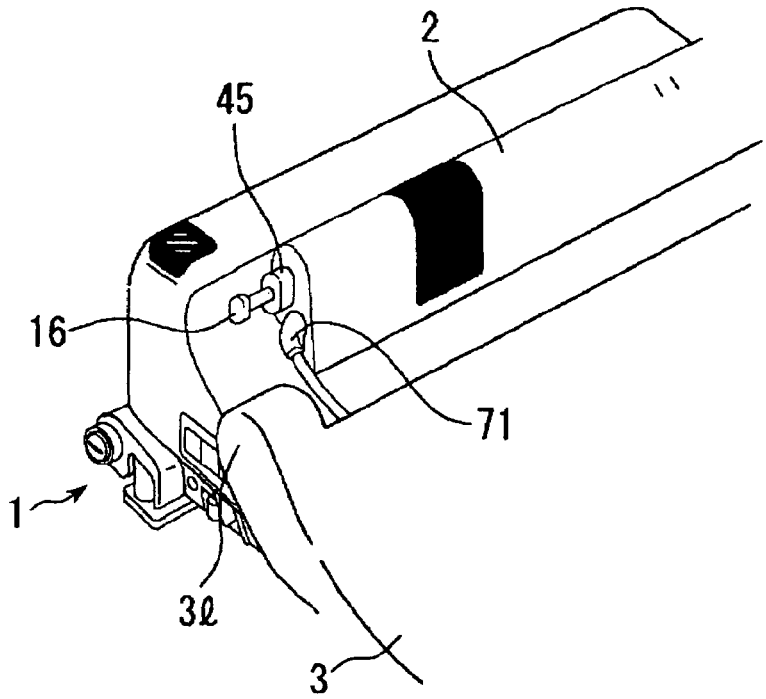
FIG. 5 is a partial perspective view showing a state in which left base end portions of the toilet seat and the toilet cover of the warm-water cleansing toilet seat device are detached from a container case.
Figure 7:
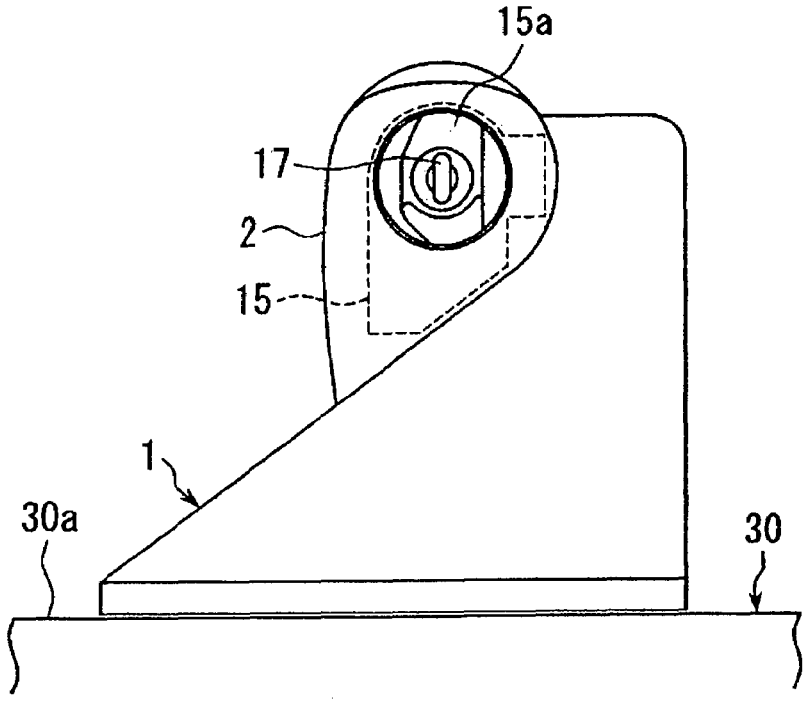
FIG. 7 is a side view shown in a direction of an arrow Q in FIG. 6.

Then, as shown in FIG. 4, the toilet seat 3 and the toilet cover 4 are lifted upward above the container case 2 while holding the vicinities of the right and left base end portions 3*l*, 4*l*, 3*r*, and 4*r* of the toilet seat 3 and the toilet cover 4 with right and left hands, respectively. Then, the first engagement member 32 is detached from a first swing shaft 16 with the base end portions 3*r* and 4*r* on the left side. The second engagement member 33 and a toilet seat transmission unit 9 are detached from a second swing shaft 17 with the base end portions 3*l* and 4*l* on the right side. Therefore, as shown in FIG. 5, the first swing shaft 16, a cap 45, and the cord 71 appear on the side of the container case 2. In the right base end portions 3*l* and 4*l* of the toilet seat 3 and the toilet cover 4, the toilet seat transmission unit 9 and the second engagement member 33 become visible. On the right side of the container case 2, as shown in FIG. 7, a protruding section 15*a* of a second lifting and lowering control unit 15, which is contained in the container case 2, and the swing shaft 17 appear.

Figure 8:
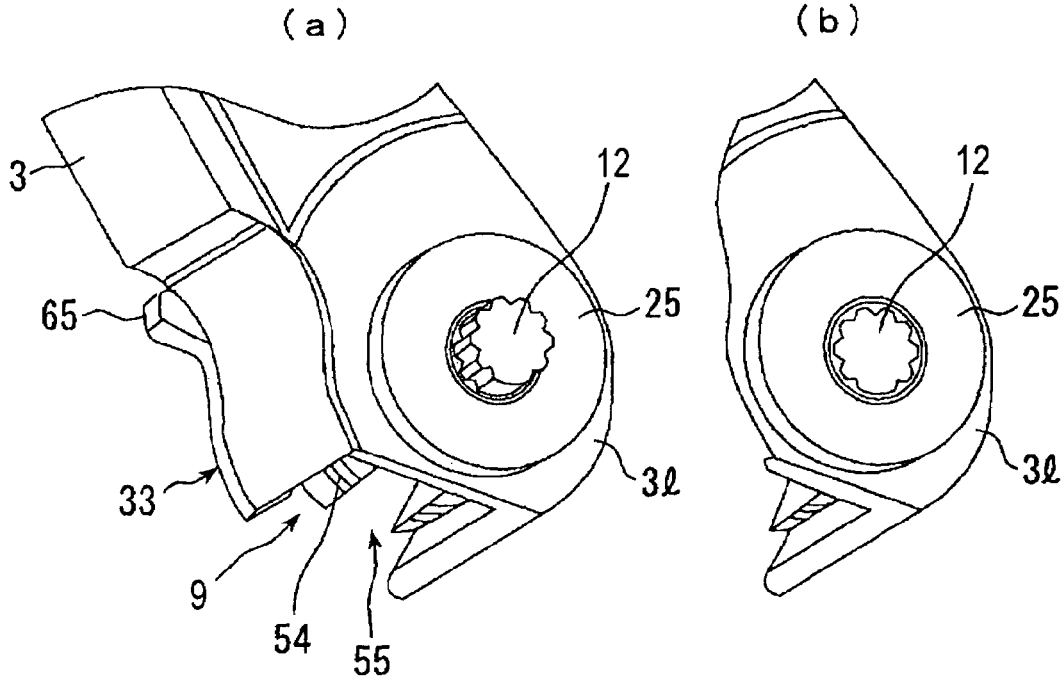
FIG. 8 is a perspective view of the right base end portion of the toilet seat detached from the container case.
Figure 15:
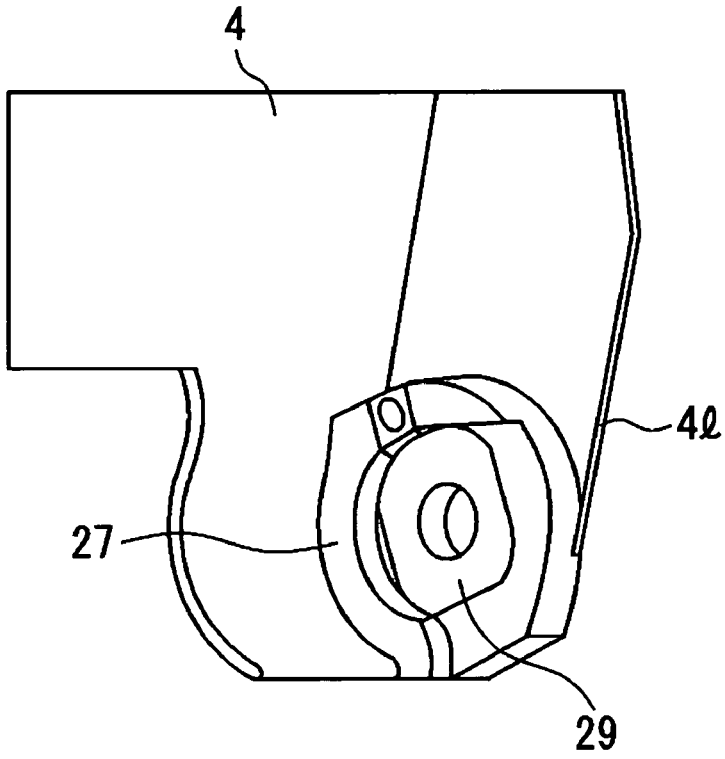
FIG. 15 is a perspective view which shows the right base end portion of the toilet cover detached from the container case.

Then, as shown in FIG. 8, the toilet seat transmission unit 9 is slid to the center of the right base end portion 3*l* of the toilet seat 3 in the direction of the center of an axis, by use of a rib 54 of the toilet seat transmission unit 9. The rib 54 is exposed from a cutout section 55 in the right base end portion 3*l* of the toilet seat 3. Thus, an end portion of an output shaft 12 of the toilet seat transmission unit 9 can be pulled out of a collar section 29 of the right base end portion 4*l* of the toilet cover 4, which is shown in FIG. 15 described later.

Figure 9:
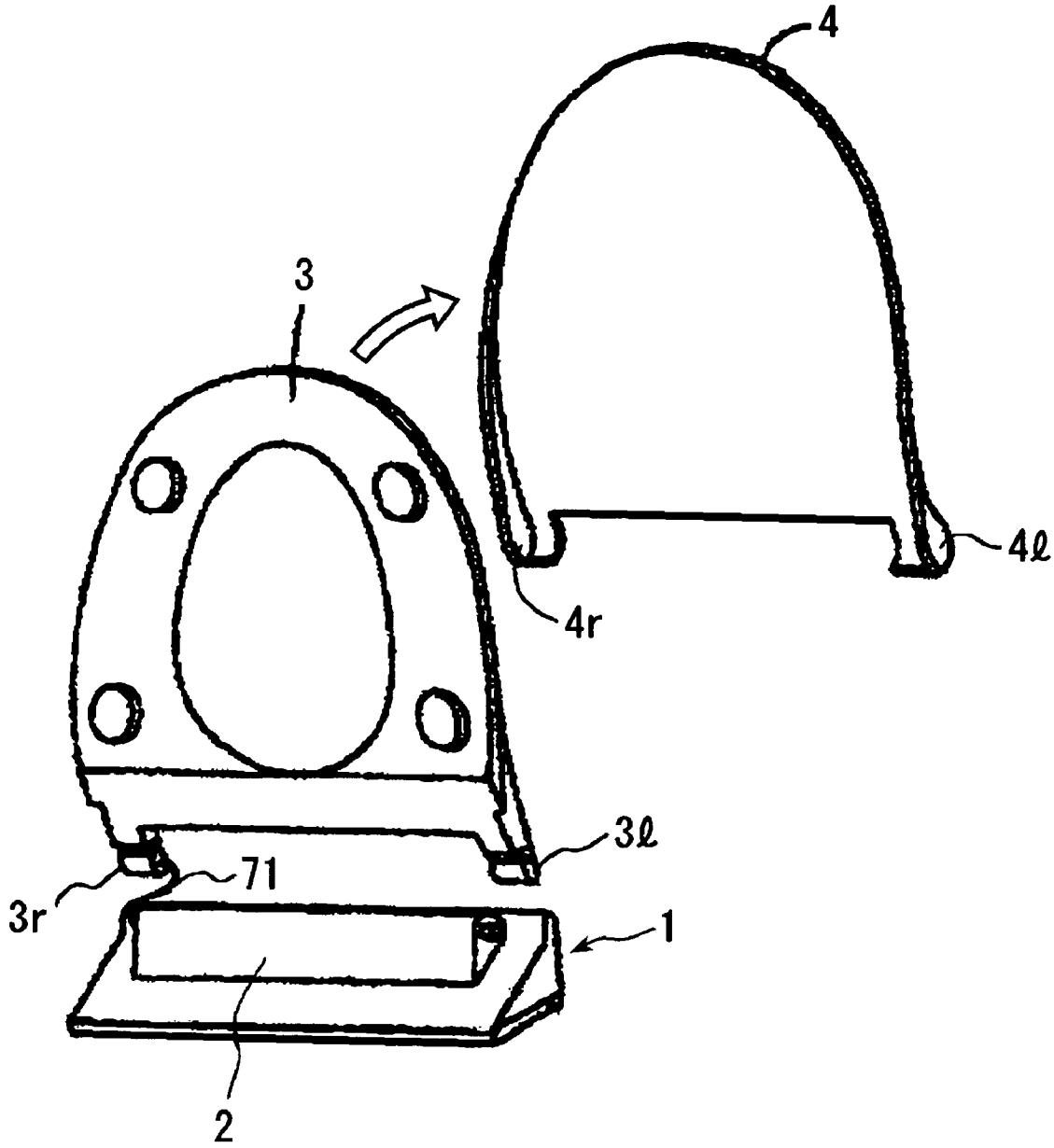
FIG. 9 is a perspective view showing a state in which the toilet seat and the toilet cover detached from the container case are separated from each other.

Accordingly, an insertion section 25 (refer to FIG. 8) provided on the right base end portion 3*l* of the toilet seat 3 is detached from a fitting section 27 (refer to FIG. 15) provided in the right base end portion 4*l* of the toilet cover 4. Then, an insertion section 44 (refer to FIG. 11) provided on the left base end portion 3*r* of the toilet seat 3 is pulled out of a fitting section 26 (refer to FIG. 14) provided in the left base end portion 4*r* of the toilet cover 4. Therefore, as shown in FIG. 9, the toilet seat 3 and the toilet cover 4 that are detached from the container case 2 are separated from each other.

Figure 10:
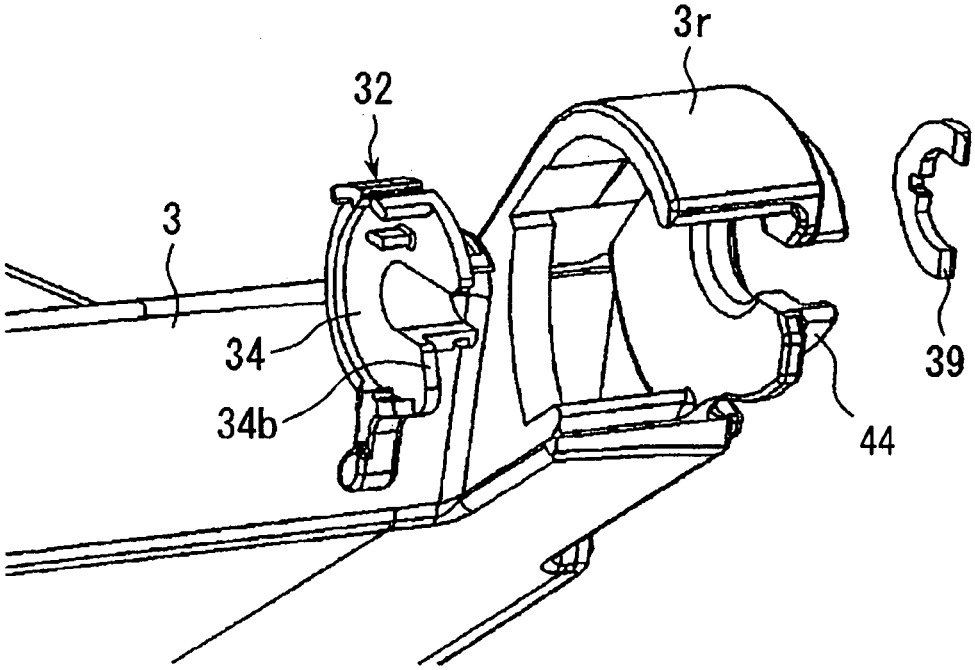
FIGS. 10 to 11 are perspective views which show the left base end portion of the toilet seat detached from the container case.
Figure 11:
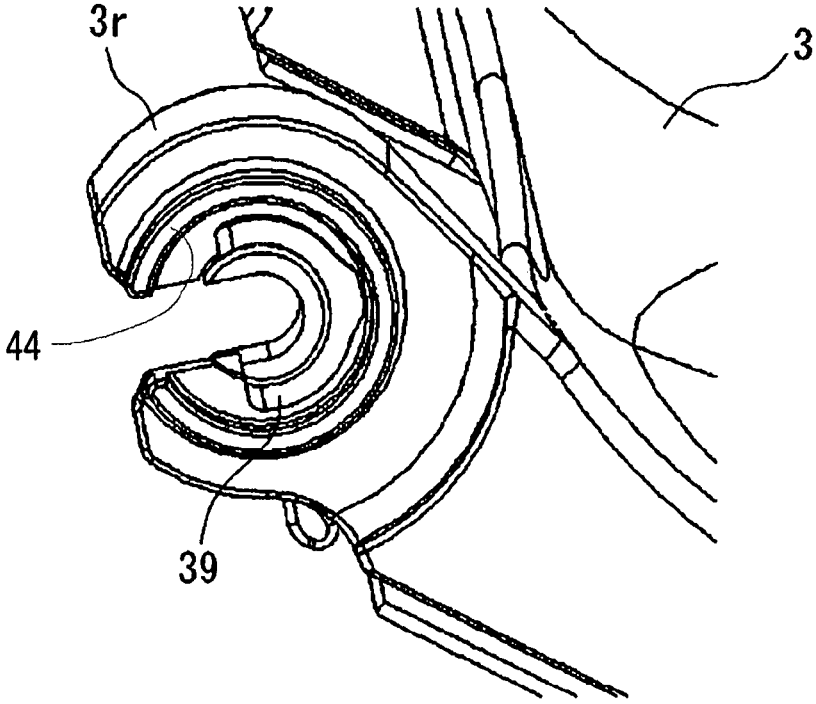
Figure 12:
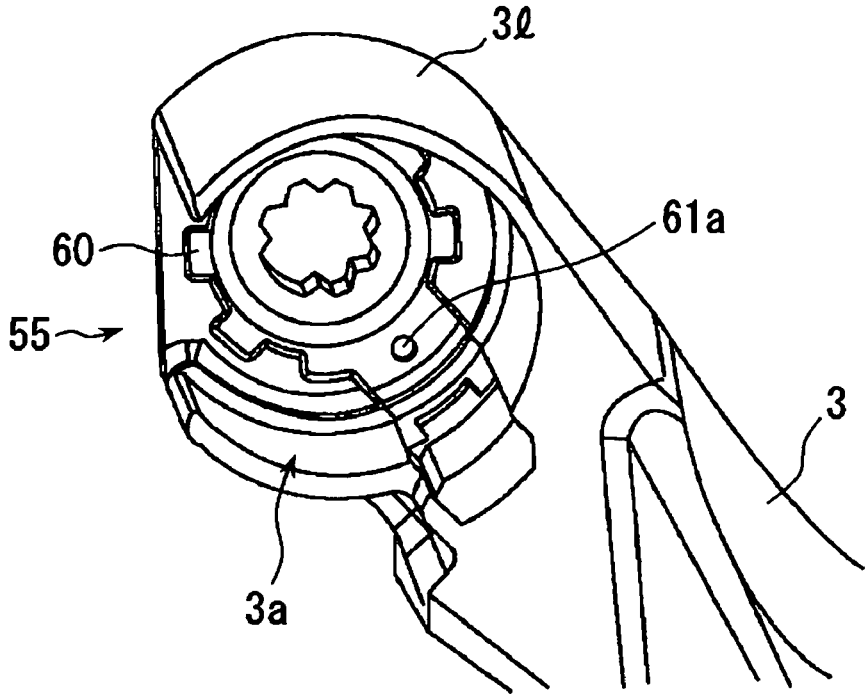
FIGS. 12 and 13 are perspective views which show the right base end portion of the toilet seat detached from the container case.
Figure 13:
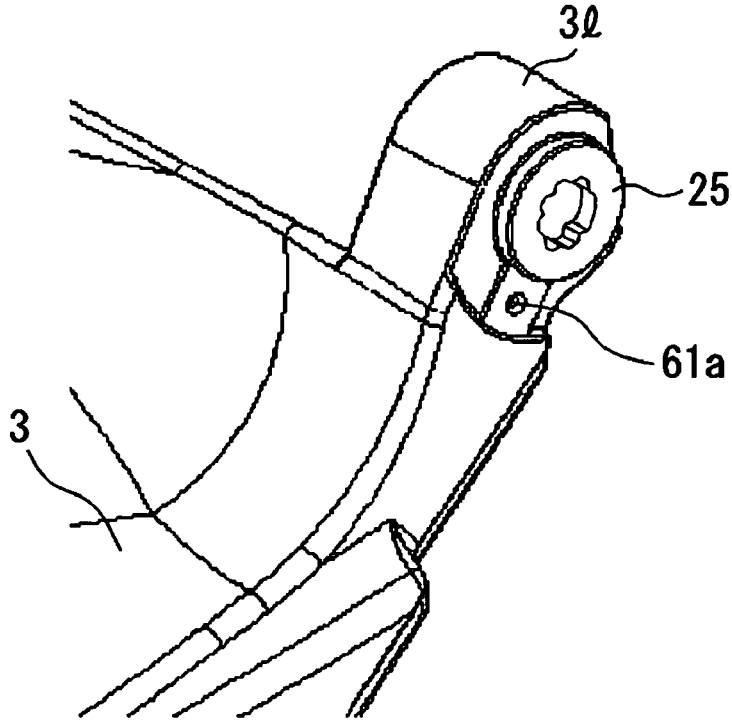

Referring to FIGS. 10 and 11, the substantially C-shaped insertion section 44, being a first swing shaft for the toilet cover, is formed in the left base end portion 3*r* of the toilet seat 3. Referring to FIGS. 12 and 13, the substantially round shaped insertion section 25, recessed sections 60, and a fixing hole 61*a* are formed in the right base end portion 3*l* of the toilet seat 3. The insertion section 25 functions as a second swing shaft for the toilet cover. Protruding sections 58 of a retaining section 56, which will be described later, are fitted into the recessed sections 60. The insertion sections 44 and 25 protrude outward in the directions of the center of an axis of the base end portions 3*r* and 3*l* of the toilet seat 3, respectively.

Figure 14:
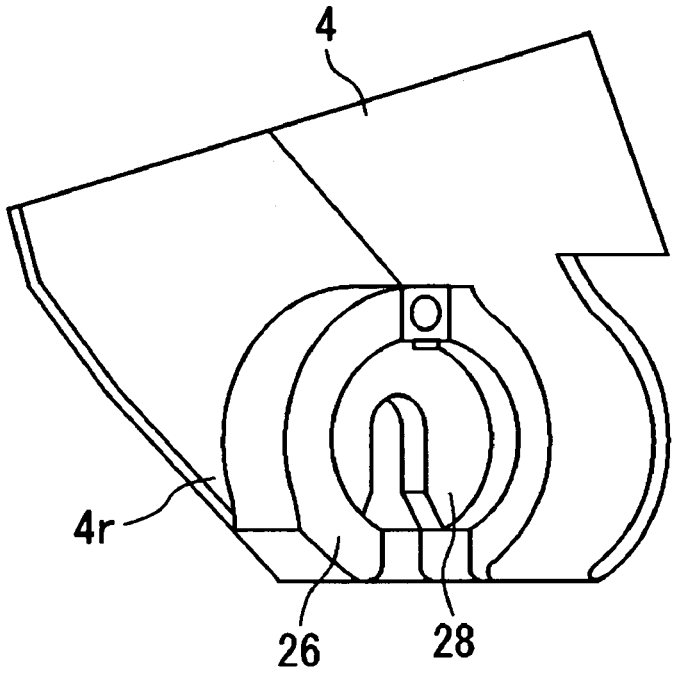
FIG. 14 is a perspective view which shows the left base end portion of the toilet cover detached from the container case.

Referring to FIG. 14, the substantially C-shaped fitting section 26, having a predetermined depth, is formed in the left base end portion 4*r* of the toilet cover 4. Referring to FIG. 15, the fitting section 27, the outside shape of which is half round and the depth of which is predetermined, is formed in the right base end portion 4*l* of the toilet cover 4. The fitting sections 26 and 27 protrude inward in the directions of the center of an axis of the base end portions 4*r* and 4*l* of the toilet cover 4, respectively.

Each of the fitting sections 26 and 27 has such a depth that the insertion sections 44 and 25 in the base end portions 3*r* and 3*l* of the toilet seat 3, respectively, and the fitting sections 26 and 27 provided inside the base end portions 4*r* and 4*l* of the toilet cover 4, respectively, are not misaligned, when the insertion sections 44 and 25 are rotatably fitted into the fitting sections 26 and 27, respectively. Here, the center of an axis of the base end portions 4*l* and 4*r* of the toilet cover 4 is the same as that of the base end portions 3*l* and 3*r* of the toilet seat 3.

The collar section 28, which is open substantially in the shape of U, is fixed inside the left fitting section 26 of the toilet cover 4, in such a manner that the opening position of the collar section 28 is aligned with the opening position of the fitting section 26. The collar section 28 is engageable with an end portion of the first swing shaft 16. A collar section 29, which is open substantially in a round shape, is fixed inside the right fitting section 27, so that the rotation of the second swing shaft 17 is not transmitted to the toilet cover 4.

The left insertion section 44 of the toilet seat 3 is fitted into the left fitting section 26 of the toilet cover 4, and then the right insertion section 25 of the toilet seat 3 is fitted into the right fitting section 27 of the toilet cover 4 to rotatably fix the right insertion section 25. Thus, the toilet cover 4 and the toilet seat 3 are integrated with each other, and can be swung separately. On the left side, the opening position of the insertion section 44 and that of the fitting section 26 are overlapped with each other, when the toilet cover 4 and the toilet seat 3 are integrated. Accordingly, it is possible to integrally attach/detach the toilet cover 4 and the toilet seat 3 to/from the first swing shaft 16 through the opening positions.

Figure 6:
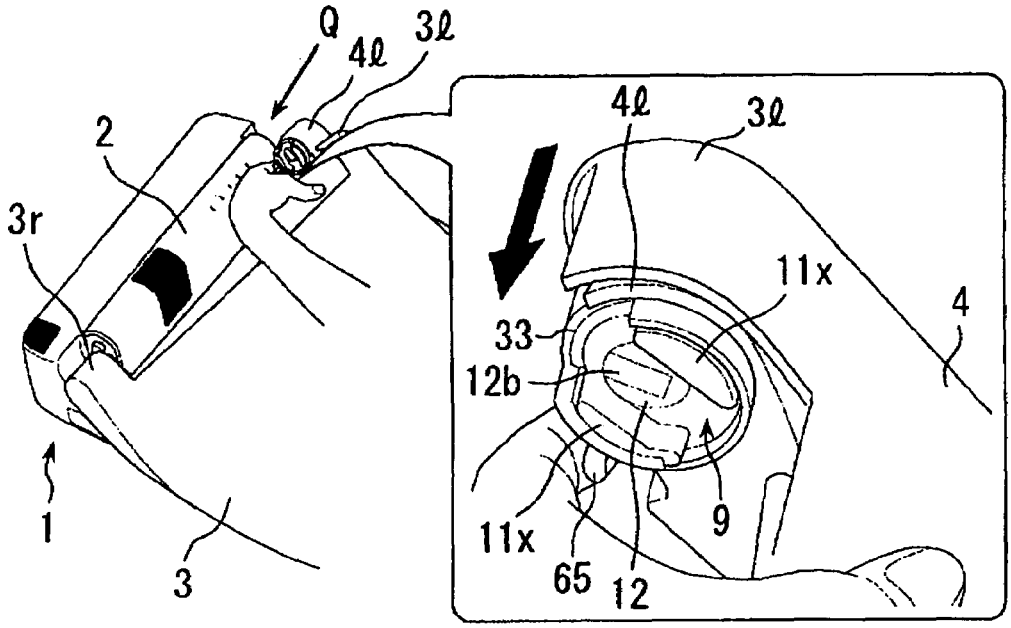
FIG. 6 is an explanatory view which shows a state in which right base end portions of the toilet seat and the toilet cover of the warm-water cleansing toilet seat device shown in FIG. 1 are detached from the container case.

The right base end portion 3*l* of the toilet seat 3 shown in FIG. 12, on the other hand, has a swing block insertion section 3*a*, into which a toilet seat transmission unit 9 is inserted movable in an axial direction as shown in FIG. 6. The toilet seat transmission unit 9 engages with the base end portion 3*l* of the toilet seat 3, and urges the toilet seat 3 to a lifted side (raised direction).

Figure 16:
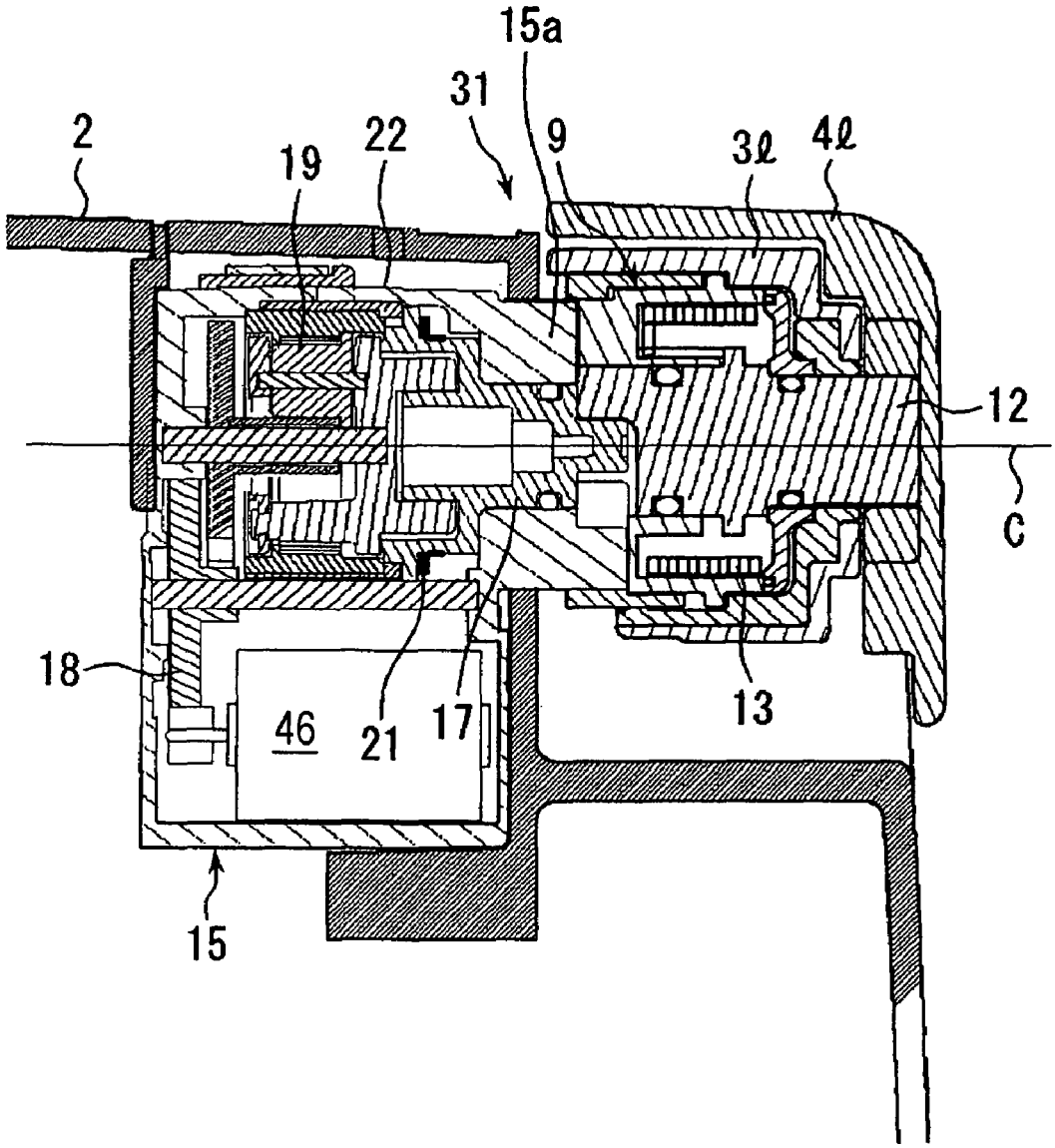
FIG. 16 is a longitudinal sectional view of a section which is indicated by an arrow P in FIG. 1.
Figure 17:
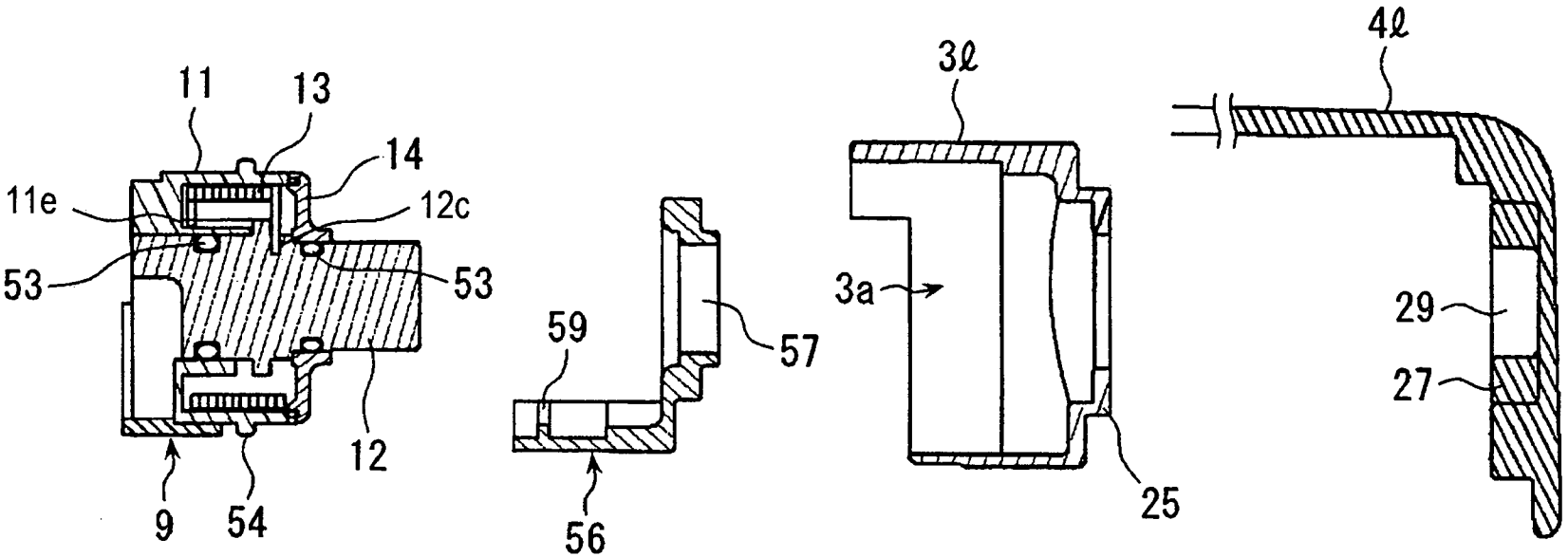
FIG. 17 is an exploded sectional view which shows the vicinity of a toilet seat transmission unit.

FIG. 16 is a longitudinal sectional view of a section which is indicated by an arrow P in FIG. 1, and FIG. 17 is an exploded sectional view which shows the vicinity of the toilet seat transmission unit. Referring to FIGS. 16 and 17, a lifting and lowering device 31 according to this embodiment comprises the lifting and lowering control unit 15, and the toilet seat transmission unit 9. The lifting and lowering control unit 15 has the swing shaft 17 (an axial member), and is indirectly fixed on the toilet bowl main body 30. The swing shaft 17 is disposed on the swing center line C of the toilet seat 3 and the toilet cover 4, which are lifted and lowered with respect to the base end portions 3*l* and 4*l*, respectively. The toilet seat transmission unit 9 contains an output shaft 12 (a swing shaft) and a torsion spring 13. The output shaft 12 is disposed on the swing center line C. One end of the output shaft 12 is detachably connected to the swing shaft 17 of the lifting and lowering control unit 15, and the other end thereof is detachably connected to the base end portion 3*l* of the toilet seat 3. The torsion spring 13 urges the output shaft 12 to the lifting direction of the toilet seat 3.

As described above, the container case 2 is attached to the toilet bowl main body 30 by being fixed on the top face of the rim 30*a* on the back side of the toilet bowl main body 30. In the container case 2, the lifting and lowering control unit 15 is fixed. Therefore, the lifting and lowering control unit 15 is indirectly fixed on the toilet bowl main body 30 through the container case 2.

Referring to FIG. 16, a base end portion of the toilet seat transmission unit 9 is coupled to the swing shaft 17 and the protruding section 15*a* of the lifting and lowering control unit 15, protruding from the container case 2. The base end portion 3*l* of the toilet seat 3 is fixed to the output shaft 12 of the toilet seat transmission unit 9, and the base end portion 4*l* of the toilet cover 4 is rotatably supported by the output shaft 12.

The lifting and lowering control unit 15 may include a motor with a speed reducer, such that the motor lifts and lowers, or only lifts the toilet seat 3 by an electric operation. The lifting and lowering control unit 15 may include a soft lowering mechanism (an example of a damper mechanism), which regulates the speed of the toilet seat 3 lowered from a lifted state to a lowered state into a gentle speed. The lifting and lowering control unit 15 may include a combination of the motor with the speed reducer and the soft lowering mechanism. The motor with the speed reducer has a drive motor (for example, a DC brush motor, an AC motor, a stepping motor, or the like), a transmission gear, a planetary gear mechanism, a torque limiter mechanism, an angle detection sensor, and the like.

The lifting and lowering control unit 15 has the swing shaft 17 protruding from a case 22. The case 22 contains a drive motor 46, which is a DC brush motor, a transmission gear 18, a planetary gear mechanism 19, a torque limiter mechanism 20, and an angle detection sensor 21. The transmission gear 18 and the planetary gear mechanism 19 transmit the rotation of the drive motor 46 while successively reducing its speed. The torque limiter mechanism 20 prevents the application of an excessive load to the drive motor 46. The angle detection sensor 21 detects the turning angle of the swing shaft 17.

In the lifting and lowering control unit 15, the transmission gear 18 decelerates the rotation of the drive motor 46. Its torque is transmitted to the planetary gear mechanism 19 in the last stage, and is transmitted to the swing shaft 17 through the torque limiter mechanism 20. After the torque of the swing shaft 17 of the lifting and lowering control unit 15 is transmitted to the output shaft 12 of the toilet seat transmission unit 9, the torque is transmitted to the base end portion 3*l* of the toilet seat 3. Thus, the toilet seat 3 is lifted or lowered pivotally about the base end portion 3*l* to open or close the top face of the rim 30*a* of the toilet bowl main body 30. In the course of this process, the toilet seat 3 is always urged in the lifting direction by the twisting force of the torsion spring 13, which is contained in the toilet seat transmission unit 9.

In the lifting and lowering control unit 15, the angle detection sensor 21 comprising a magnet and a Hall IC detects the turning angle of the swing shaft 17 to detect the lifting angle of the toilet seat 3. This detection signal is fed back to control the rotation of the drive motor 16, so that it is possible to realize the gentle lifting and lowering operation of the toilet seat 3. A turning direction may be detected by a two-phase output encoder having a slit and a photo interrupter, or determined by angle information from a potentiometer, instead of the multi-pole magnet and the Hall IC provided in the swing shaft 17. The soft lowering mechanism using the viscosity of oil exercises a damping force by the function of a valve.

Figure 18:
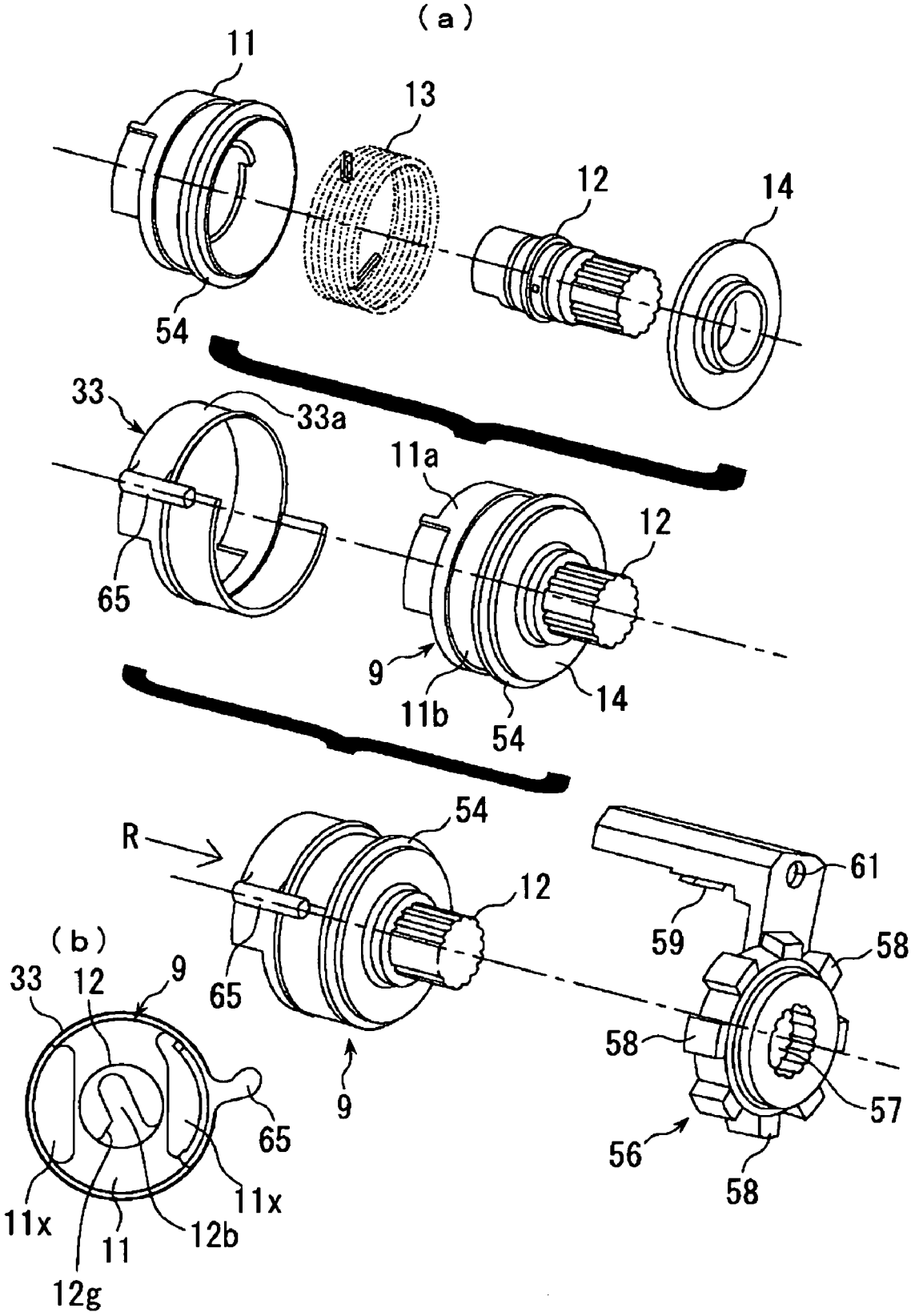
FIG. 18(*a*) is an exploded perspective view of the toilet seat transmission unit.

Referring to FIGS. 17 and 18, the structure and function of the toilet seat transmission unit 9 will be described in detail. FIG. 17 is an exploded sectional view which shows the vicinity of the toilet seat transmission unit. FIG. 18 is an exploded perspective view which shows the vicinity of the toilet seat transmission unit.

As shown in FIGS. 17 and 18, the toilet seat transmission unit 9 comprises a container cylinder 11, the output shaft 12, the torsion spring 13 (coil spring), and a container cover 14. Functional parts are contained in the container cylinder 11. The output shaft 12 is rotatably disposed in the container cylinder 11. The torsion spring 13 is disposed in the container cylinder 11 in such a manner as to surround the swing shaft 12. The container cover 14 closes an opening section of the container cylinder 11.

Since one end of the torsion spring 13 is inserted into an attachment hole 11*e* formed inside the container cylinder 11, the torsion spring 13 is fitted in the container cylinder 11 in such a state as to urge the toilet seat 3 in the lifting direction. Since the other end of the torsion spring 13 is inserted into an attachment hole 12*c* formed in the outer periphery of the output shaft 12, the torsion spring 13 is fixed on the swing shaft 12. An O-ring 53 is disposed in each of a sliding section between the container cylinder 11 and the output shaft 12, and a sliding section between the output shaft 12 and the container cover 14, in order to prevent moisture from getting into space formed by the container cylinder 11 and the output shaft 12. The torsion spring 13 has enough urging force to maintain the toilet seat 3 in the lowered state.

The rib 54 is formed on the periphery of the container cylinder 11 of the toilet seat transmission unit 9. The cutout section 55 is formed in a part of the right base end portion 3*l* of the toilet seat 3, into which the toilet seat transmission unit 9 is rotatably fitted, so that the rib 54 is always exposed from the cutout section 55, as shown in FIGS. 8 and 12.

Referring to FIG. 18(*b*), a U-shaped cutout 12*b*, the width of which is magnified toward an opening section, is formed on the left side of the output shaft 12 of the toilet seat transmission unit 9 (a section connected to the lifting and lowering control unit 15). The cutout 12*b* can be fitted over the swing shaft 17 of the lifting and lowering control unit 15 from above, in the following procedure. Accordingly, the output shaft 12 is fixed unrotatably with respect to the swing shaft 17 of the lifting and lowering control unit 15.

A right side of the output shaft 12 (a section connected to the toilet seat 3), on the other hand, protrudes from the container cover 14. A base portion of the output shaft 12 is round in cross section, and a distal end portion thereof is in the shape of serrations in cross section. Since the end portion having the serration cross section has a round outer shape, it is rotatably fitted into the collar section 29 of the base end portion 4*l* of the toilet cover 4. A part of the teeth of the serrations is formed into a different shape, or the width of part of the teeth is widened, to align the retaining section 56, which will be described later, in fitting the retaining section 56.

Referring to FIG. 18(*a*), the retaining section 56 is substantially in an L-shape. The retaining section 56 has a guide on which the toilet seat transmission unit 9 is mounted to be slidable. A through hole 57 is provided in one part of the retaining section 56, and is engaged with the output shaft 12 of the toilet seat transmission unit 9. Eight protruding sections 58 are formed at equiangular positions on the outer periphery of the retaining section 56 to be engaged with the toilet seat 3.

The through hole 57 is in the shape of the serrations in cross section, as with the distal end portion of the output shaft 12 fitted therein. A part of the teeth of the serrations is formed into a different shape, or the width of part of the teeth is widened for alignment. A stopper section 59 is provided in the middle of the other part of the retaining section 56. The stopper section 59 can make contact with the rib 54, when the toilet seat transmission unit 9 is slid in the direction of the center of the axis of the base end portion 3*l* of the toilet seat 3. As shown in FIG. 12, the recessed sections 60 are formed in the inner wall of the right base end portion 3*l* of the toilet seat 3, so that each of the protruding sections 58 of the retaining section 56 is fitted into each of the recessed sections 60.

The procedure of fixing the toilet seat transmission unit 9 on the right base end portion 3*l* of the toilet seat 3 will be described. As shown in FIG. 18(*a*), the engagement member 33 is fitted over an external cylinder section 11*a* of the toilet seat transmission unit 9. The internal diameter of the external cylinder section 11*a* is slightly larger than that of a ring section 33*a* of the engagement member 33. Thus, when the ring section 33*a* surmounts the external cylinder section 11*a* and is fitted over a small diameter section 11*b*, the toilet seat transmission unit 9 and the engagement member 33 are integrated. The ring section 33*a* and the external cylinder section 11*a* prevent the engagement member 33 from being dropped in the direction of the center of the axis.

Then, the output shaft 12 of the toilet seat transmission unit 9 is engaged with the through hole 57 of the retaining section 56. The protruding sections 58 of the retaining section 56 are fitted into the recessed sections 60 formed in the right base end portion 3*l* of the toilet seat 3. Then, a fixing hole 61 formed in a pole of the retaining section 56 is overlapped with a fixing hole 61*a* formed in the base end portion 3*l*, and a self-tapping screw is screwed in these holes to fasten. Thus, the toilet seat transmission unit 9 is disposed inside of the right base end portion 3*l* of the toilet seat 3. Accordingly, the toilet seat transmission unit 9 is slidable in the direction of the center of the axis of the base end portion 3*l* of the toilet seat 3, and the toilet seat transmission unit 9 is prevented from falling off the right base end portion 3*l* of the toilet seat 3.

Since the retaining section 56 is elastically deformable outward before being fixed on the base end portion 3*l* of the toilet seat 3, the toilet seat transmission unit 9 is detachable from the retaining section 56. After the retaining section 56 is fixed on the base end portion 3*l* of the toilet seat 3, the base end portion 3*l* of the toilet seat 3 restrains the outward deformation of the retaining section 56. Therefore, the toilet seat transmission unit 9 is prevented from falling off in a thrust direction. A clearance between the retaining section 56 and the external cylinder section 11*a* is narrow, and hence the engagement section 33 cannot be deformed to the extent of surmounting the external cylinder section 11*a*. Therefore, it is also possible to prevent the engagement section 33 from falling off in the direction of the center of the axis, in a like manner.

The toilet seat transmission unit 9 is disposed between the lifting and lowering control unit 15 and the base end portion 3*l* of the toilet seat 3, as described above. Thus, the toilet seat 3 is urged in the lifting direction by the torsion spring 13 contained in the toilet seat transmission unit 9 through the swing shaft 12.

Accordingly, when the toilet seat 3 and the toilet cover 4 are lifted up in a case where a man urinates, the toilet seat 3 and the toilet cover 4 can be stably held in the raised positions, without undesirably falling during urination. When the toilet seat 3 is lowered to the horizontal state, the self weight torque of the toilet seat 3 becomes larger than the urging force of the torsion spring 13. Therefore, the toilet seat 3 is not lifted up from the toilet bowl main body 30.

Figure 19:
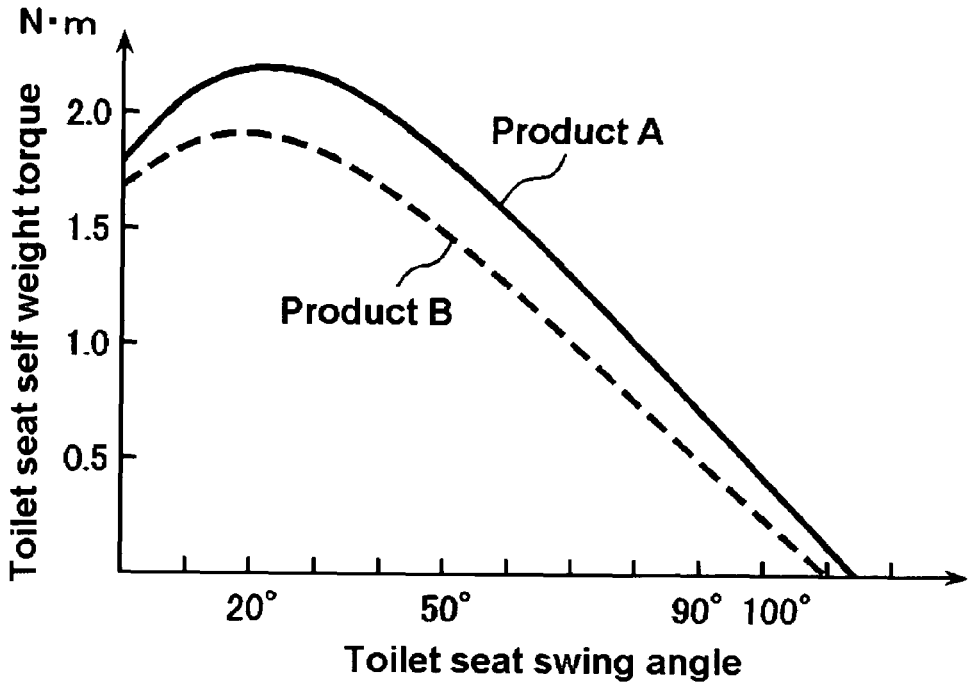
FIG. 19 is a graph showing the relation between a "toilet seat swing angle" and "toilet seat self weight torque" in two types of toilet seat devices (product A and product B) with different toilet seat self weight torque.
Figure 20:
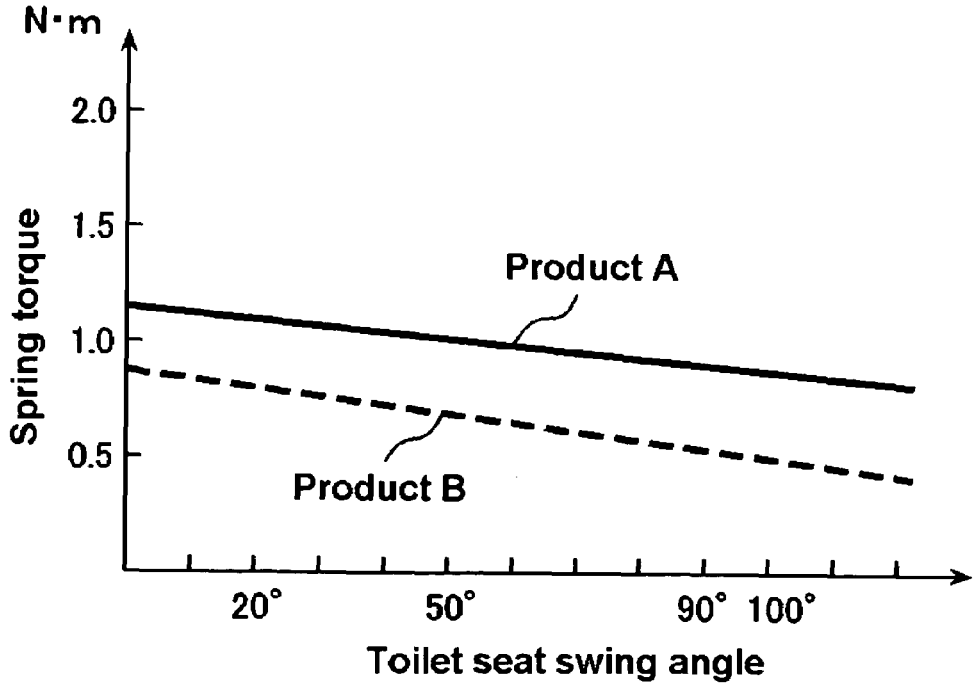
FIG. 20 is a graph showing the relation between the "toilet seat swing angle" and "spring torque" of the toilet seat transmission unit in each of the products A and B.
Figure 21:
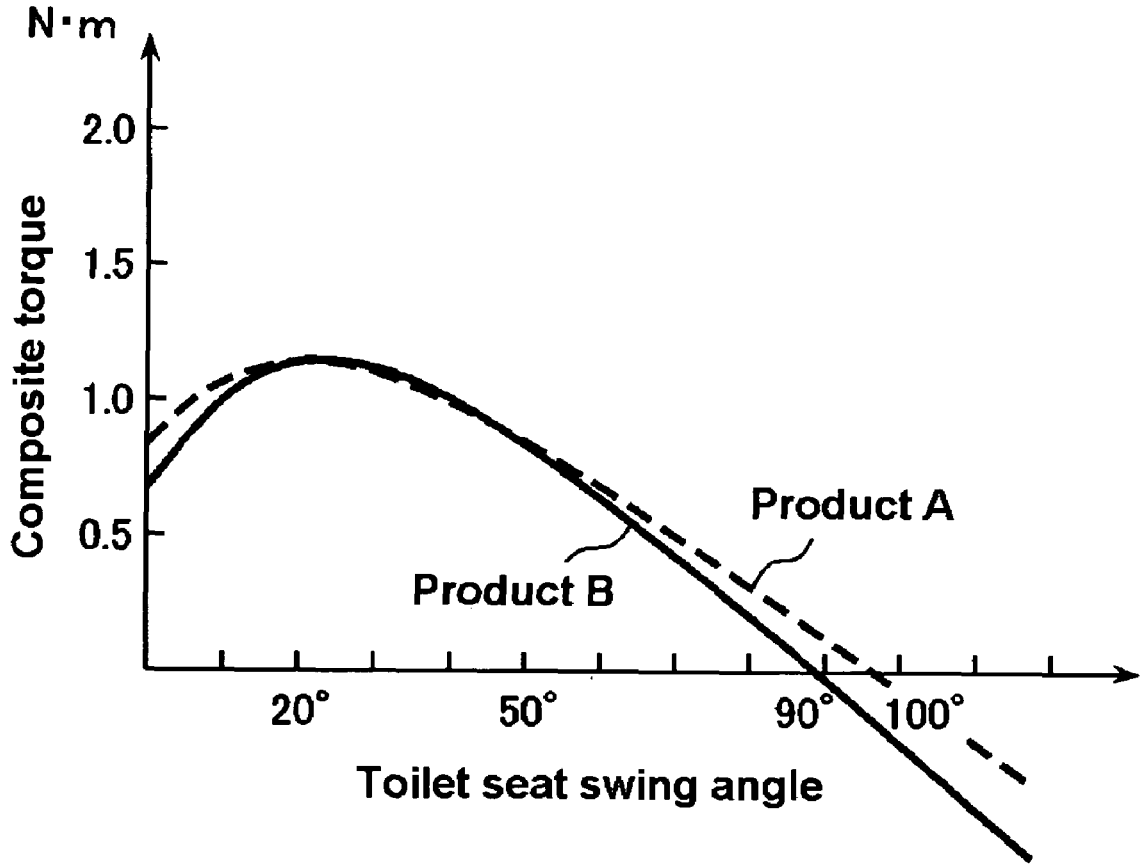
FIG. 21 is a graph showing the relation between the "toilet seat swing angle" and "composite torque" of the self weight torque of the toilet seat and the spring torque of the toilet seat transmission unit in each of the products A and B.

FIG. 19 is a graph showing the relation between a "toilet seat swing angle" and "toilet seat self weight torque" in two types of toilet seat devices (product A and product B), which have different toilet seat self weight torque. FIG. 20 is a graph showing the relation between the "toilet seat swing angle" and "spring torque" of the toilet seat transmission unit in each of the products A and B. FIG. 21 is a graph showing the relation between the "toilet seat swing angle" and "composite torque" in each of the products A and B. The "composite torque" refers to a composition of the toilet seat self weight torque and the spring torque of the toilet seat transmission unit.

Referring to FIG. 19, the "toilet seat self weight torque" of the product A is larger than the "toilet seat self weight torque" of the product B over the whole range of the "toilet seat swing angle." In such products A and B, suppose the case where toilet seat transmission units with torsion springs having different torque characteristics, as shown in FIG. 20, are used. In this case, when torque for urging the toilet seat in the lifting direction is applied to the products A and B, the "composite torque" (composite torque of the toilet seat self weight torque and the spring torque of the toilet seat transmission unit) becomes almost equal between the products A and B, as shown in FIG. 21.

Accordingly, a plurality of types of toilet seat transmission units, which contains a torsion spring with different torque characteristics, are prepared in advance. Of such a toilet seat transmission unit group, an appropriate toilet seat transmission unit is selected and mounted in accordance with a difference in toilet seat self weight torque in various product variations. Thus, it is possible to provide almost the same "composite torque" composed of "toilet seat self weight torque" and "spring torque" of the toilet seat transmission unit, even if the toilet seat self weight torque differs from one product to another.

As described above, the toilet seat transmission unit containing the torsion spring having the torque characteristics appropriate to each toilet seat is selected and used. Thus, it is possible to provide almost the same "composite torque" composed of "toilet seat self weight torque" and "spring torque" of the toilet seat transmission unit, even if the toilet seat self weight torque differs in accordance with the types of the toilet seats. Therefore, for composing the lifting and lowering unit 31, one type of the lifting and lowering control unit 15 or one type of damper device is available in all products, so that it is possible to achieve commonality of structural parts. The torque characteristics of the torsion spring 13 contained in the toilet seat transmission unit 9 are changeable by adjusting a spring constant. To adjust the spring constant, the diameter of a wire of the torsion spring 13, the diameter of the center thereof, the number of winding, or the like is changed. Therefore, it is relatively easy to prepare the plurality of types of toilet seat transmission units.

Figure 22:
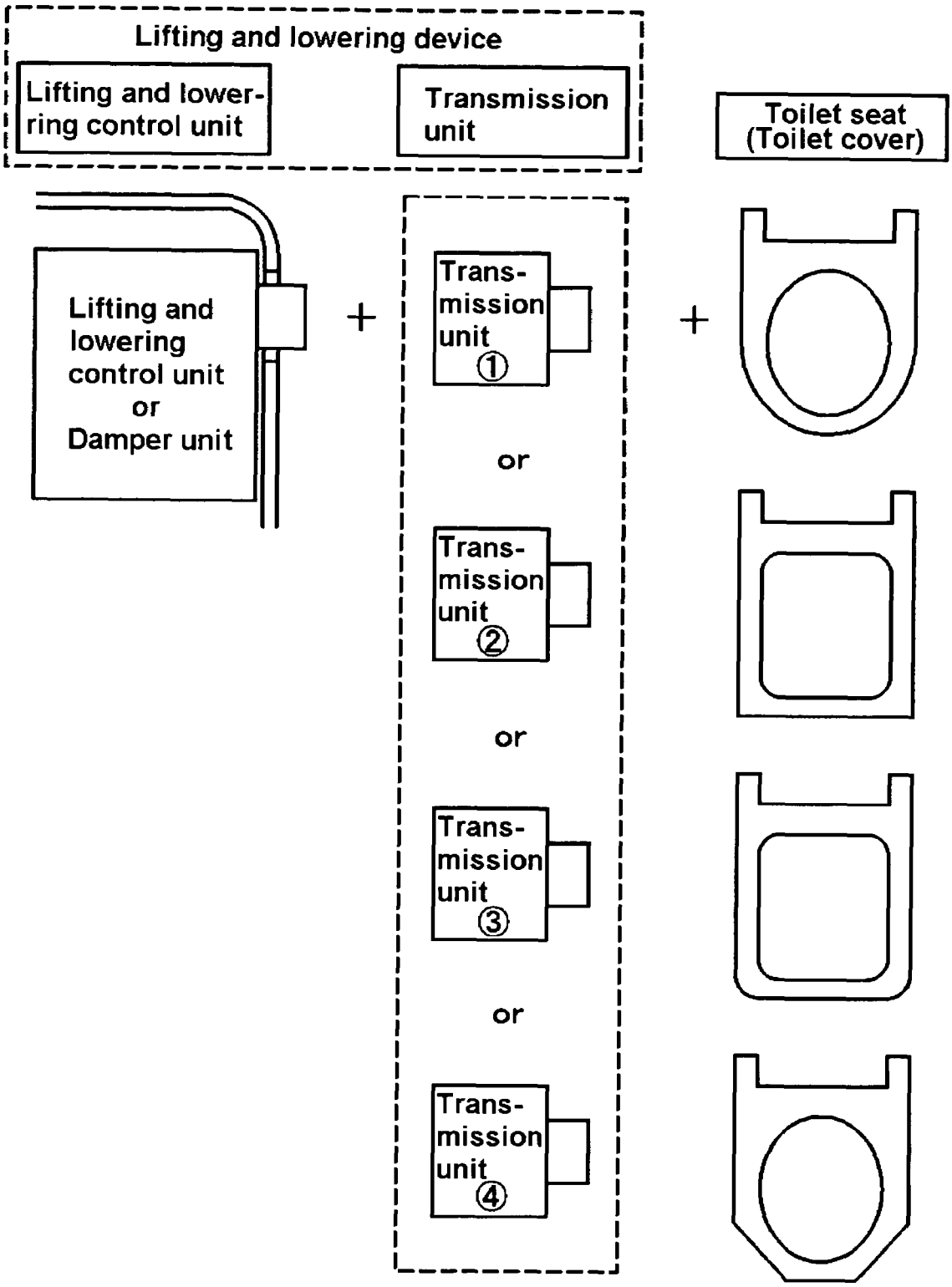
FIG. 22 is a conceptional view showing combinations of a single lifting and lowering control unit or damper unit, a plurality of transmission units, and a plurality of types of toilet seats (toilet covers).

Taking a case where, as shown in FIG. 22, there are four types of toilet seats (toilet covers) with different shapes and sizes, for example, four types of transmission units 1 to 4 are prepared in accordance with self weight torque different from one toilet seat (toilet cover) to another. In this case, four types of lifting and lowering devices can be composed of a combination of the one type of lifting and lowering control unit (or damper unit) and one of the four types of transmission units 1 to 4. Thus, the one type of lifting and lowering control unit (or damper unit) is applicable to the four types of toilet seats (toilet covers). In other words, it is possible to achieve commonality of the lifting and lowering control unit (or the damper unit), and hence the manufacturing cost and management cost of the lifting and lowering device are reduced.

In this embodiment, the toilet seat transmission unit 9 is inserted into the swing block insertion section 3*a* of the base end portion 3*l* of the toilet seat 3. Thus, it is unnecessary to provide space for disposing the toilet seat transmission unit 9 within the lifting and lowering control unit 15 or the like, and hence it is possible to miniaturize a warm-water cleansing toilet seat device 1. In FIG. 16 showing the first embodiment, the toilet seat transmission unit 9 is provided only for the toilet seat 3, but a toilet cover transmission unit may be used in the toilet cover 4. In such a case, the toilet cover transmission unit is contained in space inside of the left base end portion 3*r* of the toilet seat 3.

Next, a transmission unit according to a second embodiment of the present invention will be described with reference to FIG. 23. The same reference numbers refer to parts which have the same function and effect as those of the structural parts of the foregoing toilet seat transmission unit 9.

A toilet seat transmission unit 29 according to this embodiment comprises a container cylinder 11, a swing shaft 12, torsion springs 13*a* and 13*b*, and a container cover 14. One end of the torsion spring 13*a* is inserted into an attachment hole 11*c*, so that the torsion spring 13*a* is fixed to the container cylinder 11. The other end of the torsion spring 13*a* is inserted into an attachment hole 12*e*, so that the torsion spring 13*a* is fixed to the swing shaft 12. One end of the torsion spring 13*b* is inserted into an attachment hole 11*d*, so that the torsion spring 13*b* is fixed to the container cylinder 11. The other end of the torsion spring 13*b* is inserted into an attachment hole 12*d*, so that the torsion spring 13*b* is fixed to the swing shaft 12.

In the toilet seat transmission unit 29, one end of each of a plurality of torsion springs 13*a* and 13*b* contained in the container cylinder 11 is fixed to the swing shaft 12, and the other end is fixed to the container cylinder 11. Thus, the amount of twist torque for urging the swing shaft 12 in the lifting direction of the toilet seat is larger than that in the case of the toilet seat transmission unit 9. Therefore, the toilet seat transmission unit 29 is appropriate as a structural part of a lifting and lowering mechanism for a toilet seat that has larger self weight torque than the foregoing toilet seat 3.

By changing the number of the torsion springs contained in the toilet seat transmission unit, as described above, the present invention is applicable to the self weight torque characteristics of the toilet seat or a toilet cover in further various product variations. Since the toilet seat transmission unit 29 contains the plurality of torsion springs 13*a* and 13*b*, it is possible to reduce a load per single torsion spring. Furthermore, both ends of the torsion springs 13*a* and 13*b* are fixed at a plurality of points, so that it is possible to disperse occurring stress to the attachment holes 11*c*, 11*d*, 12*d*, and 12*e*. Therefore, the container cylinder 11 and the swing shaft 12 can be made of a resin, and hence it is possible to promote reduction in manufacturing cost and weight.

Next, a transmission unit according to a third embodiment of the present invention will be described with reference to FIG. 24. The same reference numbers refer to parts which have the same function and effect as those of the structural parts of the foregoing toilet seat transmission unit 9.

A toilet seat transmission unit 39 according to this embodiment comprises a container cylinder 11, a swing shaft 12, torsion springs 13*c* and 13*d*, an intermediate swing shaft 23, and a container cover 14. One end of the torsion spring 13*c* is inserted into an attachment hole 11*c*, so that the torsion spring 13*c* is fixed to the container cylinder 11. The other end of the torsion spring 13*c* is inserted into an attachment hole 23*a*, so that the torsion spring 13*c* is fixed to the intermediate swing shaft 23. One end of the torsion spring 13*d* is inserted into an attachment hole 23*b*, so that the torsion spring 13*d* is fixed to the intermediate swing shaft 23. The other end of the torsion spring 13*d* is inserted into an attachment hole 12*f*, so that the torsion spring 13*d* is fixed to the swing shaft 12.

Of a plurality of torsion springs 13*c* and 13*d*, as described above, the one end of the one torsion spring 13*d* is fixed to the swing shaft 12, and the other end is fixed to the intermediate swing shaft 23. Also, the one end of the other torsion spring 13*c* is fixed to the intermediate swing shaft 23, and the other end is fixed to the container cylinder 11. Accordingly, even if there is not enough space for containing the torsion springs, it is possible to obtain relatively strong torsion force by coupling a plurality of torsion springs through the intermediate swing shaft 23. Therefore, it is possible to properly set the torque of the torsion springs, which urge a toilet seat or toilet cover in a lifting direction, in accordance with the self weight torque characteristics of the toilet seat or toilet cover in various product variations.

Figure 23:
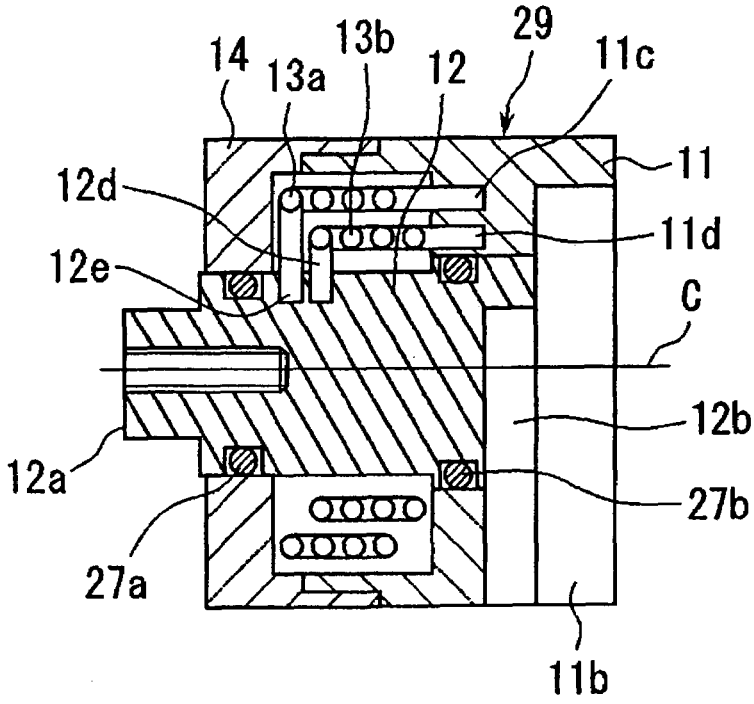
FIG. 23 is a sectional view of a transmission unit according to a second embodiment of the present invention.
Figure 24:
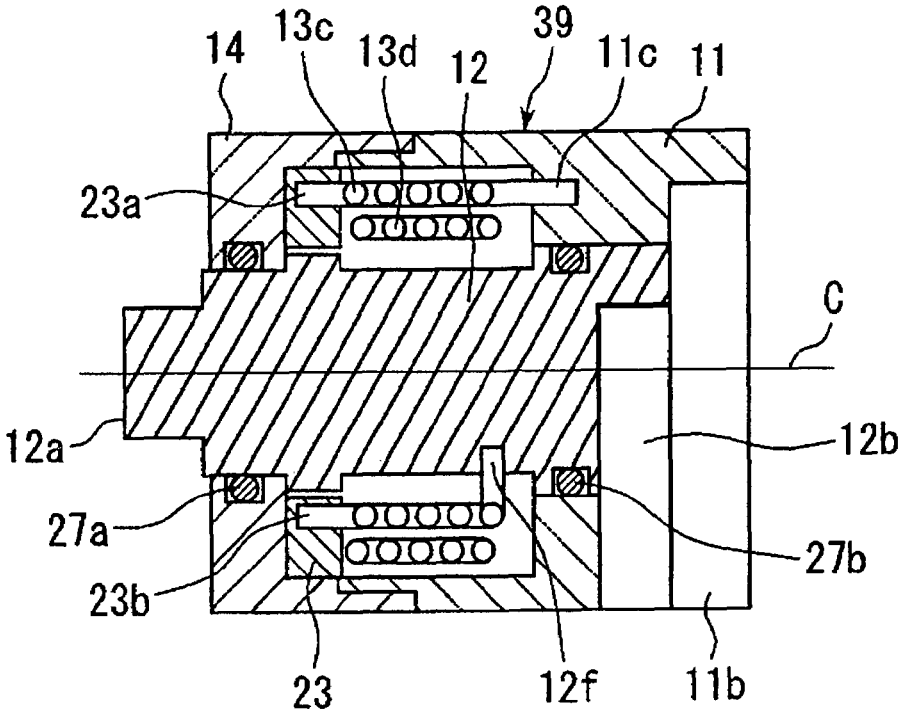
FIG. 24 is a sectional view of a transmission unit according to a third embodiment of the present invention.

As shown in FIGS. 23 and 24, O-rings 27*a* and 27*b* are provided in sliding sections between the container cylinder 11 and the swing shaft 12, and between the container cover 14 and the swing shaft 12, so that water, cleaning solution, or the like does not enter the transmission unit 29, 39. Therefore, since the toilet seat 3 or the toilet cover 4 is immersible for cleaning, the torsion spring 13 does not corrode by the cleaning, and hence reliability and durability are improved.

Furthermore, even when space for the swing block insertion section 3*a* in the base end portion 3*l* of the toilet seat 3 cannot be sufficiently secured, it is possible to increase the number of winding of the torsion spring inside the container cylinder 11. Accordingly, a spring constant can be reduced, and it is possible to reduce variation in torsion spring torque within the range of a toilet seat swing angle. Therefore, the lifting and lowering operation of the toilet seat becomes smooth, and it is possible to prevent the toilet seat from being incompletely leveled.

In the foregoing embodiments, the lifting and lowering control unit 15 is disposed in the container case 2 as a lifting and lowering control unit. A damper unit (the so-called gentle lowering mechanism) which has the function of making the lowering operation of the toilet seat 3 gentle may be disposed instead of the lifting and lowering control unit 15. By use of the transmission unit 9, as described above, the same lifting and lowering control unit is applicable to a plurality of types of toilet seats and toilet covers with different sizes and shapes, so that it is possible to achieve commonality of parts.

Figure 25:
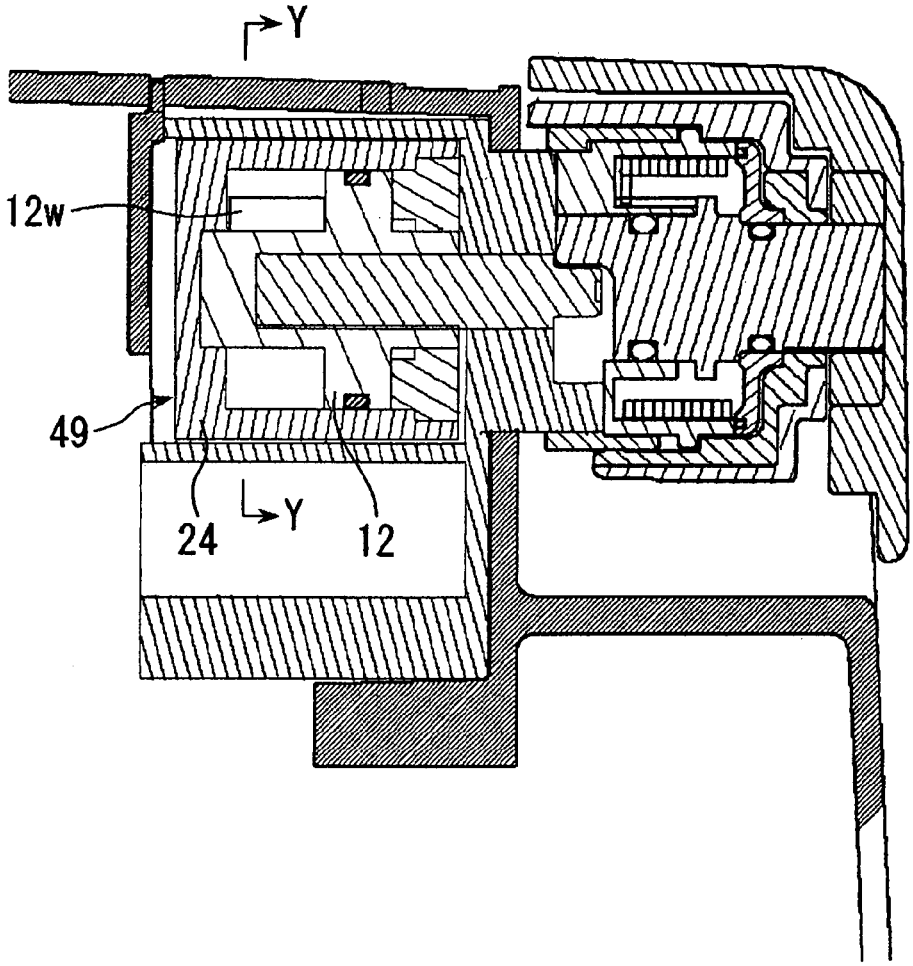
FIG. 25 is a sectional view showing a state in which a damper unit is disposed in the lifting and lowering device for the toilet seat or toilet cover shown in FIG. 16, instead of the lifting and lowering control unit.
Figure 26:
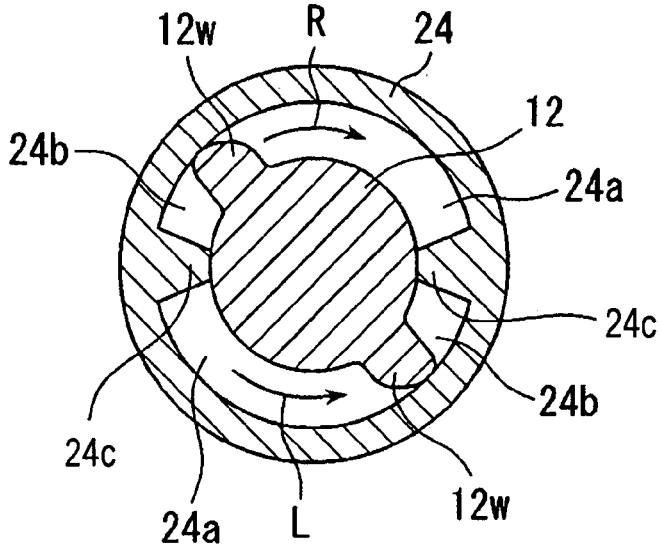
FIG. 26 is a partly omitted sectional view taken along the line Y-Y in FIG. 25.

Next, referring to FIGS. 25 and 26, a case where a damper unit is provided instead of the lifting and lowering control unit 15 will be described. In a damper unit 49, two blades 12*w* are provided on the outer periphery of a swing shaft 12 at an interval of 180 degrees, and two partition walls 24*c* are provided on the inner periphery of a container cylinder 24 at an interval of 180 degrees. The container cylinder 24 is charged with viscous oil such as silicon oil. When the blades 12*w* of the damper unit 49 rotate in the direction of an arrow R, the oil smoothly flows from an oil containing chamber 24*a* into an oil containing chamber 24*b* through clearance between the blade 12*w* and the inner periphery of the container cylinder 24. When the blades 12*w* of the damper unit 49 rotate in the direction of an arrow L, the oil flows from the oil containing chamber 24*b* into the oil containing chamber 24*a* little by little.

Then, a method for reinstalling the base end portions 3*l*, 4*l*, 3*r*, and 4*r* of the toilet seat 3 and the toilet cover 4, which were detached from the container case 2 by a procedure shown in FIGS. 2 to 4 in the foregoing first embodiment, in the container case 2 will be described.

First, the insertion section 44 provided in the left base end portion 3*r* of the toilet seat 3 is fitted into the fitting section 26 provided in the left base end portion 4*r* of the toilet cover 4. Then, the insertion section 25 provided in the right base end portion 3*l* of the toilet seat 3 is fitted into the fitting section 27 provided in the right base end portion 4*l* of the toilet cover 4. Thus, the base end portions 4*l* and 4*r* of the toilet cover 4 are coaxially aligned with the base end portions 3*l* and 3*r* of the toilet seat 3. The engagement member 33 is slid along the retaining section 56 to an end of the base end portion 3*l* of the toilet seat 3 in the direction of the center of the axis, by use of the rib 54 of the toilet seat transmission unit 9 exposed from the cutout section 55. An end of the output shaft 12 of the toilet seat transmission unit 9 is fitted into the collar section 29 of the toilet cover 4, to integrate the toilet cover 4 and the toilet seat 3 in such a manner as to be separately rotatable.

The overlapped toilet cover 4 and the toilet seat 3 are lowered downward from an area above the container case 2, and the first swing shaft 16 and the second swing shaft 17 are fitted into the openings of the engagement members 32 and 33, respectively. At this time, since the first engagement member 32 is rotatable, an inclined section 34*b* of a main body 34 of the first engagement member 32 guides the swing shaft 16 into the center of the axis, in fitting the swing shaft 16.

Figure 27:
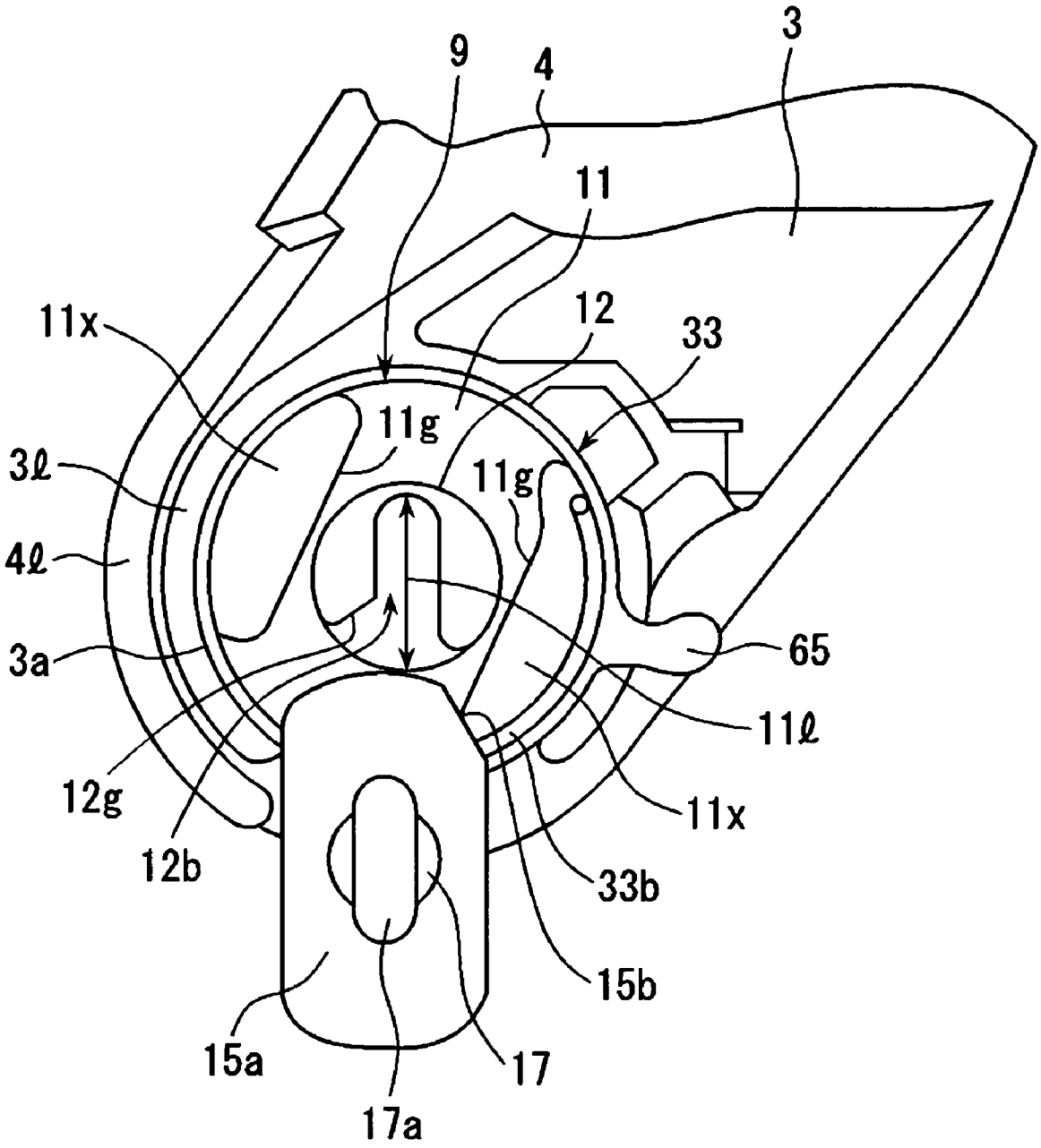
FIG. 27 is a schematic view showing a state in which a toilet seat transmission unit in right base end portions of the toilet seat and the toilet cover is engaged with the lifting and lowering control unit.

Next, a method for reinstalling the base end portions 3*l* and 4*l* of the toilet seat 3 and toilet cover 4 in the container case 2 will be described with reference to FIGS. 27 to 30. Referring to FIG. 27, in the toilet seat transmission unit 9, guide faces 11*g* of a pair of nipper sections 11*x* are oppositely disposed in parallel with each other. In a state where the transmission unit 9 is detached from the container case 2, the parallel direction of the guide faces 11*g* is not in parallel with the longitudinal direction 121 of the cutout section 12*b* of the swing shaft 12. The parallel direction of the guide faces 11*g* and the longitudinal direction 121 of the cutout section 12*b* are displaced approximately 25 to 35 degrees with respect to each other. This aims to maintain the twist torque, which is applied to the swing shaft 12 by the torsion spring contained in the container cylinder 11, at a constant value or more, even in a state where the transmission unit 9 is detached from the container case 2.

Figure 29:
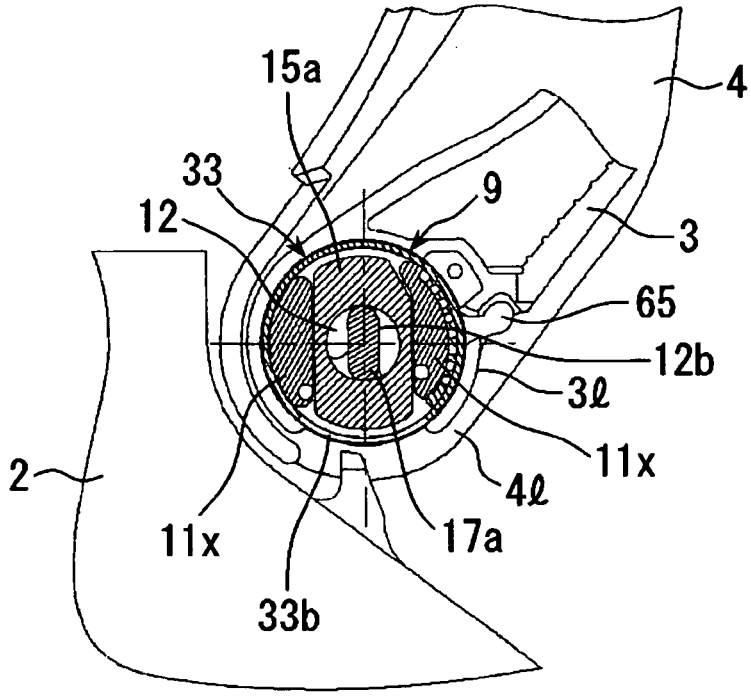
FIGS. 29 and 30 are sectional views showing a state in which the toilet seat transmission unit is engaged with the lifting and lowering control unit.
Figure 30:
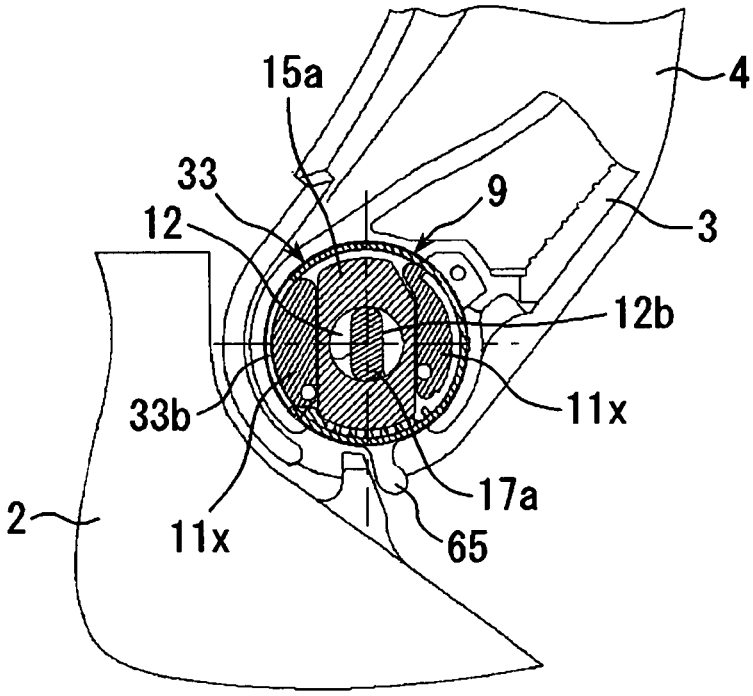

Accordingly, when the end portion 17*a* of the swing shaft 17 of the lifting and lowering control unit is engaged and coupled with the cutout section 12*b* of the output shaft 12, as shown in FIGS. 29 and 30, the parallel direction of the guide faces 11*g* becomes in parallel with the longitudinal direction 121 of the cutout section 12*b* of the output shaft 12. Therefore, the twist torque applied to the swing shaft 12 is applied to the base end portion 3*l* of the toilet seat 3, and hence the toilet seat 3 is urged in the lifting direction.

Figure 28:
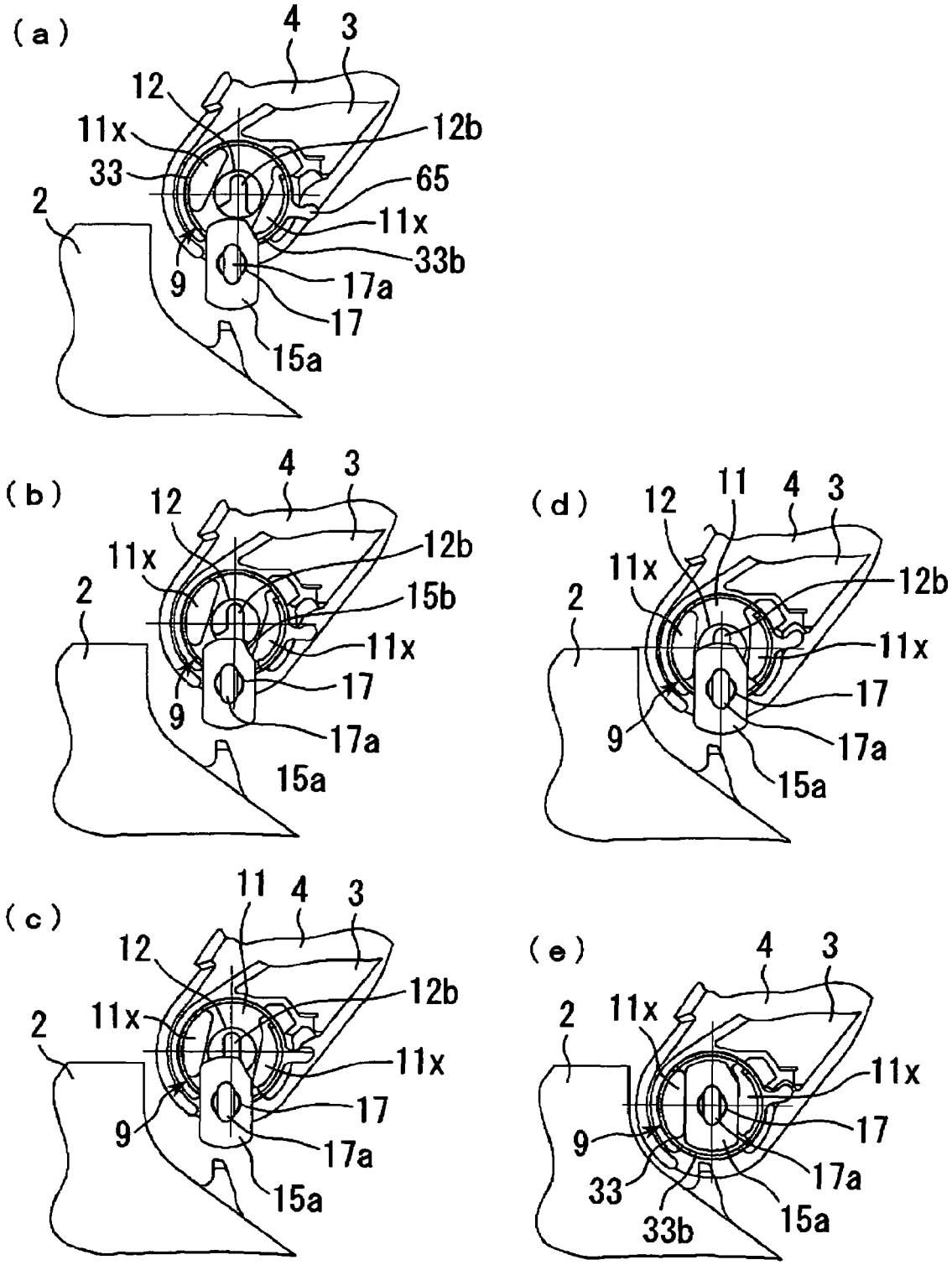
FIG. 28 is an explanatory view which schematically shows the procedure of engaging the toilet seat transmission unit with the lifting and lowering control unit.

First, as shown in FIG. 28(*a*), the toilet seat transmission unit 9 in an unlocked state is gradually pressed down to the protruding section 15*a* protruding from the container case 2 and the end portion 17*a* of the swing shaft 17, while the cutout section 33*b* of the engagement member 33 is pointed downward. Then, the lower end portion of one of the nipper sections 11*x* makes contact with a guide slope 15*b* of the protruding section 15*a* as shown in FIG. 28(*b*).

When the base end portions 3*l* and 4*l* are continuously pressed downward, the nipper section 11*x* moves downward along the guide slope 15*b*. The nipper sections 11*x* rotate in a counterclockwise direction as shown in FIG. 28(*c*), so that the parallel direction of the guide faces 11*g* of the nipper sections 11*x* corresponds with the direction of the protruding section 15*a*, and the protruding section 15*a* is fitted between the pair of the nipper sections 11*x* as shown in FIG. 28(*d*), thus comprising a fitting portion. The protruding section 15*a* is finally brought into a state shown in FIG. 28(*e*). The nipper sections 11*x* nip the protruding section 15*a*, and the container cylinder 11 is fixed in the container case 2. At the same time, the coupling between the end portion 17*a* of the swing shaft 17 and the cutout section 12*b* of the output shaft 12 is completed.

At this time, guide faces 12*g*, which are formed in the opening section of the cutout section 12*b* of the output shaft 12 in such a manner as to magnify the width of the cutout section 12*b*, guide the end portion 17*a* of the swing shaft 17. Therefore, it is possible to securely fit the end portion 17*a* into the cutout section 12*b*.

According to the steps described above, the base end portions 3*l* and 4*l* of the toilet seat 3 and toilet cover 4 are coupled to the protruding section 15*a* and the swing shaft 17 of the lifting and lowering control unit through the toilet seat transmission unit 9. After that, the lever section 65 of the engagement member 33 is manually operated to rotate the whole engagement member 33 in the toilet cover lowering direction. Then, the cutout section 33*b* of the engagement section 33 moves to a back side as shown in FIG. 30, and the toilet seat transmission unit 9 is brought into a locked state. Therefore, the toilet seat transmission unit 9 cannot be detached upward from the protruding section 15*a* of the container case 2, and attachment is completed.

Accordingly, when the toilet seat 3 and the toilet cover 4 are completely coupled to the container case 2 through the transmission unit 9, the toilet seat 3 is urged in the lifting direction. Therefore, the toilet seat 3 and the toilet cover 4 do not undesirably fall down, if the toilet seat 3 and the toilet cover 4 are lifted up when a man urinates.

Since the engagement member 33 is lock means to the container case 2, it is possible to unlock the lock means when cleaning the toilet or the like by rotating the lever section 65 of the engagement member 33. By carrying out the above-described procedure in reverse, the toilet seat 3 and the toilet cover 4 are detached from the container case 2. Therefore, it is possible to easily clean the toilet, and workability is improved.

INDUSTRIAL APPLICABILITY

As described above, the lifting and lowering device for the toilet seat or toilet cover, and the transmission unit for the lifting and lowering device according to the present invention are available as a lifting and lowering mechanism for a toilet seat or toilet cover in a warm-water cleansing toilet seat device, a heated toilet seat device, or the like installed in a Western-style toilet.

The invention claimed is:

1. A lifting and lowering device for a toilet seat or toilet cover, comprising:

a lifting and lowering control unit to be indirectly fixed to a toilet bowl main body, the lifting and lowering control unit having an axial member to be disposed on a swing center line of a toilet seat or a toilet cover being pivotable about respective base end portions of the toilet seat or toilet cover in a lifting direction and a lowering direction, and a transmission unit adapted to be arranged within a swing block insertion section provided in one of the base end portions of the toilet seat, the transmission unit having a swing shaft to be disposed on the swing center line, wherein a first end portion of the swing shaft is to be coupled to the toilet seat or the toilet cover, and wherein a second end portion of the swing shaft is detachably coupled to the axial member of the lifting and lowering control unit at a cutout section formed on the second end portion of the swing shaft such that the transmission unit is structured so as to be detachable from the lifting and lowering control unit by moving the toilet seat or the toilet cover upwardly so as to detach the axial member of the lifting and lowering control unit from the cutout section formed on the second end portion of the swing shaft, and an urging member for urging the swing shaft so as to rotate in the lifting direction of the toilet seat or toilet cover.

2. The lifting and lowering device according to claim 1, further comprising:

a fitting portion for detachably coupling the lifting and lowering control unit to the transmission unit.

3. The lifting and lowering device according to claim 2, wherein the fitting portion includes a protruding section provided on one of the lifting and lowering control unit and the transmission unit, and a nipper section provided on the other of the lifting and lowering control unit and the transmission unit for nipping the protruding section.

4. The lifting and lowering device according to claim 3, wherein the protruding section has a guide face for guiding the protruding section into a fitting position of the nipper section.

5. The lifting and lowering device according to claim 1, wherein an axial end face of the axial member is provided with a protruding section, and an axial end face of the second end portion of the swing shaft is provided with the cutout section such that the protruding section can be fitted into the cutout section.

6. The lifting and lowering device according to claim 5, wherein the cutout section includes a guide face for guiding the protruding section into a fitting position of the cutout section.

7. An apparatus comprising:

a toilet seat and a toilet cover, the toilet seat and toilet cover having respective base end portions and being pivotable about the respective base end portions in a lifting direction and a lowering direction; and a lifting and lowering device including a lifting and lowering control unit to be indirectly fixed to a toilet bowl main body, the lifting and lowering control unit having an axial member disposed on a swing center line of the toilet seat or the toilet cover, and a transmission unit arranged within a swing block insertion section provided in one of the base end portions of the toilet seat, the transmission unit having a swing shaft which is disposed on the swing center line, a first end portion of the swing shaft being coupled to the toilet seat or the toilet cover, and a second end portion of the swing shaft being detachably coupled to the axial member of the lifting and lowering control unit at a cutout section formed on the second end portion of the swing shaft such that the transmission unit is structured so as to be detachable from the lifting and lowering control unit together with the toilet seat by moving the toilet seat or the toilet cover upwardly so as to detach the axial member of the lifting and lowering control unit from the cutout section formed on the second end portion of the swing shaft, and an urging member for urging the swing shaft so as to rotate in the lifting direction of the toilet seat or toilet cover.

* * * * *